US006325131B1

(12) United States Patent
Dekker et al.

(10) Patent No.: US 6,325,131 B1
(45) Date of Patent: Dec. 4, 2001

(54) CORD SPOOL

(75) Inventors: Nicolaas Dekker, Bergschenhoek; Antonius Johannes Josephus Horsten, Den Haag, both of (NL)

(73) Assignee: Hunter Douglas Industries B.V. (NL)

( * ) Notice: Subject to any disclaimer, the term of this patent is extended or adjusted under 35 U.S.C. 154(b) by 0 days.

(21) Appl. No.: 09/551,234

(22) Filed: Apr. 17, 2000

(30) Foreign Application Priority Data

Apr. 16, 1999 (EP) ..... 99201187

(51) Int. Cl.[7] ..... E06B 9/30
(52) U.S. Cl. ..... 160/170 R; 160/193
(58) Field of Search ..... 160/173 R, 170 R, 160/171 R, 191, 192, 193

(56) References Cited

U.S. PATENT DOCUMENTS

| | | | | |
|---|---|---|---|---|
| 13,251 | | 7/1855 | Bixler . | |
| 2,737,235 | | 3/1956 | Hediger . | |
| 3,160,200 | * | 12/1964 | McKee et al. | 160/193 X |
| 3,352,349 | | 11/1967 | Hennequin . | |
| 3,499,478 | * | 3/1970 | Schneider | 160/193 X |
| 4,427,050 | * | 1/1984 | Toppen | 160/315 |
| 4,697,630 | | 10/1987 | Rude . | |
| 4,760,622 | * | 8/1988 | Rohrman | 16/196 |
| 4,914,780 | * | 4/1990 | Rogers et al. | 16/193 |
| 5,054,162 | * | 10/1991 | Rogers | 16/198 |
| 5,133,399 | * | 7/1992 | Hiller et al. | 160/170 R X |
| 5,228,491 | | 7/1993 | Rude et al. . | |
| 5,259,433 | * | 11/1993 | Cloutier | 160/193 X |
| 6,003,584 | * | 12/1999 | Weinreich | 160/170 R X |

FOREIGN PATENT DOCUMENTS

| | | |
|---|---|---|
| 389516 | 9/1908 | (FR) . |
| 1157647 | 6/1958 | (FR) . |

* cited by examiner

*Primary Examiner*—David M. Purol
(74) *Attorney, Agent, or Firm*—Dorsey & Whitney LLP

(57) ABSTRACT

A cord spool for an architectural covering, such as a Venetian blind, having a rotatable central shaft for opening and closing the covering. The cord spool includes a circumferential surface, about which an operating cord can be wound that can be driven in opposite directions to open and close the covering. The spool is arranged so as to regulate or prevent an F(pull) gradient when pulling on one end of the operating cord to open the covering; and has a variable coupling connected to the central shaft and the circumferential surface for automatically actuating the regulating or preventing operation when the torque on the central shaft, exerted by the window covering, is greater than the torque on the circumferential surface, exerted by the operating cord as it is being pulled to open the covering.

35 Claims, 8 Drawing Sheets

CORD SPOOL

CROSS REFERENCE TO RELATED APPLICATION

This application corresponds to and claims priority to European Application No. 99201187.4, filed Apr. 16, 1999. This European application is hereby incorporated by reference as though fully set forth herein.

BACKGROUND OF THE INVENTION a. Field of the Invention

This invention relates to a cord spool for a cord driven mechanism for controlling the retraction and deployment of an architectural covering, especially a covering for an architectural opening, such as a window blind or shade. This invention particularly relates to a cord spool which counteracts the increasing downward force which must be applied to an operating cord to open a window covering—to overcome the increasing weight and/or frictional resistance of the covering, as it is opened. The invention quite particularly relates to a cord spool for a venetian blind which is raised by winding lift cords around a central shaft or on separate spools on the central shaft of the head rail of the blind.

b. Description of the Related Art

When raising a conventional Venetian blind to open it, its lift cords pull its bottom rail upwardly as a result of its operating cord or pull cord being pulled downwardly or of other means, such as a motor. As the percentage of the blind that is lifted increases, the weight of the blind, already lifted, pulls downwardly on the lift cords. The percentage of the blind that has not yet been lifted is supported by its ladder cords.) The force needed to continue to raise the blind has to overcome continuously the increasing weight of the amount of the blind already lifted. In this regard, the initial raising force overcomes the weight of the bottom rail. Subsequent raising forces are variable and are related to the percentage of the blind, already raised. This is because the weight, to be pulled up, increases as the percentage of the blind already raised increases. Additionally, friction in the cord system for raising the blind will also gradually increase as the blind is raised, thereby increasing the required raising forces.

Thus, there will normally be a significant gradient in the raising forces needed to open a Venetian blind. If a person is raising the blind by pulling downwardly on its operating cord, the person will experience the significant raising force gradient as the blind is opened. If the person is strong, he will often use excessive force to raise the last part of the blind. This can cause the bottom rail of the blind to slam into the head rail, thereby damaging the blind. Excessive raising forces pulling on the operating cord can also make it wear more quickly. By comparison, people with muscle-weakening diseases or rheumatism will often find it difficult to fully raise the blind comfortably because of the significant raising force gradient. If a motor is used, the motor will either be adapted to supply a constant force, which will raise the last part of the blind more slowly, or to supply extra force to compensate for the significant raising force gradient encountered in raising the blind. This often requires expensive electronic circuitry and/or elaborate automatic gear boxes in motor driven blinds.

Cord spools, which counteract the increasing raising forces needed to open such blinds, are known, for example from U.S. Pat. No. 13 251 (1855) and French patents 1 157 647 and 389 516. In such cord spools, an operating cord is wound around a threaded cone. As a blind is raised, the operating cord is wound around progressively larger diameters of the cone. The leverage effect of the larger diameters increases the raising forces to counteract the increasing weight of the percentage of the blind, already raised.

Such cord spools have several drawbacks. One drawback is that all the operating cord is stored on the cord spool, which takes up a lot of space. Another drawback is that there is no relation between the increasing weight of the percentage of the blind, already raised, and the increased raising force provided by the leverage effect caused by winding the operating cord on increasingly larger cone diameters. As a result, the increase in raising force can easily exceed the increasing weight of the percentage of the blind, already raised, resulting in excessive raising forces being exerted on the last part of the blind, to be opened. This can cause the bottom rail of the blind to slam into the head rail. The reason for this problem is that it is very difficult to correctly dimension such a cord spool in relation to the total weight of a blind. In this regard, the correct dimensions of the cord spool (i.e., its length, slope, and thread pitch) and the length of the operating cord would have to be calculated against the height, width, number of slats and total weight of the raised blind. These calculations would have to be made for each blind, since blinds are often made to measure. This would require, in effect, a differently dimensioned cord spool for each different blind which is highly undesirable in modern manufacturing where head rail mechanisms are typically designed for a wide variety of sizes and types of blinds.

SUMMARY OF THE INVENTION

In accordance with this invention, an improved cord spool is provided for a architectural covering, such as a Venetian blind, having a rotatable central shaft for opening and closing the covering; the cord spool comprising: a circumferential surface, about which an operating cord can be wound that can be driven in opposite directions to open and close the covering; means for regulating or preventing an F(pull) gradient when pulling on one end of the operating cord to open the covering; and a variable coupling means connected to the central shaft and the circumferential surface for automatically actuating the means for regulating or preventing an F(pull) gradient when the torque on the central shaft, exerted by the window covering, is greater than the torque on the circumferential surface, exerted by the operating cord as it is being pulled to open the covering.

Advantageously, the means for regulating or preventing an F(pull) gradient comprises means for increasing the diameter of the circumferential surface.

Also advantageously, the variable coupling means tightens when the torque of the window covering on the central shaft is greater than the torque on the circumferential surface of the operating cord, as it is being pulled to open the covering. It is especially advantageous that the variable coupling means comprises a spring, particularly a coil spring, having an inherent tightness that is intermittently less than the torque of the covering, exerted on the central shaft, minus the torque of the operating cord, exerted on the circumferential surface, during the raising of the covering.

In one advantageous embodiment, the means for regulating or preventing an F(pull) gradient comprises:

an outer cone having an outer surface that has: i) a first longitudinal end with a relatively small, first lateral diameter, ii) a second longitudinal end with a relatively much larger, second lateral diameter, and iii) an intermediate longitudinal section, between the ends of the outer cone and having progressively larger lateral diameters which increase longitudinally from the first end to the second end of the outer cone; the outer cone being rotatable about its longitudinal axis; the outer cone also having at least one longitudinally-extending slit between its first and second ends;

the operating cord being wound circumferentially about the outer surface of the outer cone in the first lateral direction and having a pair of depending end portions on laterally opposite sides of the outer cone;

an inner rod that is within the outer cone and has a first longitudinal end and a second longitudinal end, connected to the central shaft; an outer surface of the inner rod having a thread that is wound circumferentially in a first lateral direction and that advances from the first end to the second end of the inner rod; the inner rod being rotatable about its longitudinal axis; and means for pushing the operating cord longitudinally along the outer surface of the outer cone; the pushing means being slidable in the thread of the inner rod and extending through the slit and radially outwardly of the outer cone between: i) the pair of end portions of the operating cord and ii) the first end of the outer cone; the slit being adapted to urge the pushing means to move circumferentially in the thread of the inner rod when the outer cone rotates about the inner rod; and the variable coupling having a first end, connected to the second end of the inner rod, and a second end, connected to the second end of the outer cone; the variable coupling means being adapted to connect the outer cone and the inner rod so that they: i) rotate together in the same direction and ii) the outer cone rotates relative to the inner cone when the torque of the covering on the central shaft is greater than the torque on the circumferential surface of the operating cord, as it is being pulled to open the covering;

whereby when the torque of the covering on the central shaft is greater than the torque on the circumferential surface of the operating cord, as it is being pulled to open the covering, the pushing means automatically moves the operating cord longitudinally along the outer surface of the outer cone.

In this embodiment, it is particularly advantageous that the means for pushing the operating cord longitudinally comprises: a following part, slidably movable along the thread of the inner rod and extending outwardly of the outer cone—especially where the following part comprises: a foot which fits loosely within the thread and a radially-extending pusher tab which is on the foot and extends through and outwardly of the slit in the outer cone; the foot being adapted to easily move circumferentially within the thread about the inner rod when the tab is pushed by rotation of the slit with rotation of the outer cone about the inner rod.

In other advantageous embodiments, the means for regulating or preventing an F(pull) gradient comprises:

a two-part diabolo with a pair of intersecting cone-like parts on opposite longitudinal sides; or an inverted diabolo with a pair of connected cone-like sides on opposite longitudinal sides; and wherein a part or side of the diabolo is movable along the central shaft towards the other part or side of the diabolo.

Further advantageously, the variable coupling means comprises a compression spring and a slipping clutch, especially where the slipping clutch is between opposite ends of the central shaft and the compression spring is rotatably positioned around the central shaft and with its opposite ends biased against the means for regulating or preventing an F(pull) gradient and against a side of the slipping clutch. It is particularly advantageous that the means for regulating or preventing an F(pull) gradient comprises the two-part diabolo or the inverted diabolo, quite particularly where an end of the spring is biased against the movable part or side of the diabolo and another end of the spring is biased against a first half of the slipping clutch that is rotatable about the central shaft; and wherein a second half of the slipping clutch is fixed to the central shaft; whereby the variable coupling means has an inherent tightness which is a function of a longitudinal force of the spring on the first half of the clutch and of the inherent sliding friction of facing surfaces of the slipping clutch halves, and the tightness of the variable coupling means increases due to compression of the spring when the torque of the covering, exerted on the central shaft, is greater than the torque of the operating cord, exerted on the circumferential surface, as the cord is being pulled to open the covering, so that the tightness of the variable coupling means is intermittently less than the torque of the covering on the central shaft minus the torque of the operating cord on the circumferential surface during the opening of the covering.

In these advantageous embodiments, the increased leverage provided by the increasingly larger diameters of the circumferential surface, about which the operating cord is wound as the covering is opened or raised, serves to offset, or compensate for, the progressively increasing force needed to pull the operating cord further downwardly to further raise the covering. In this regard, the variable coupling means automatically actuates the means for regulating or preventing an F(pull) gradient, whereby the operating cord is wound about circumferences of progressively greater diameters only when an increased leverage is needed. The cord spool of such embodiments can also be easily designed to provide such features when incorporated in a wide variety of sizes, weights and types of architectural coverings.

BRIEF DESCRIPTION OF THE DRAWINGS

FIG. 2 is an exploded view of a second embodiment of a cord spool of this invention for a Venetian blind;

DETAILED DESCRIPTION OF THE PREFERRED EMBODIMENTS

Further aspects of the invention will be apparent from the detailed description below of particular embodiments.

FIGS. 1–4 show a cord spool 1 of this invention for a Venetian blind (not shown).

Figure 1:
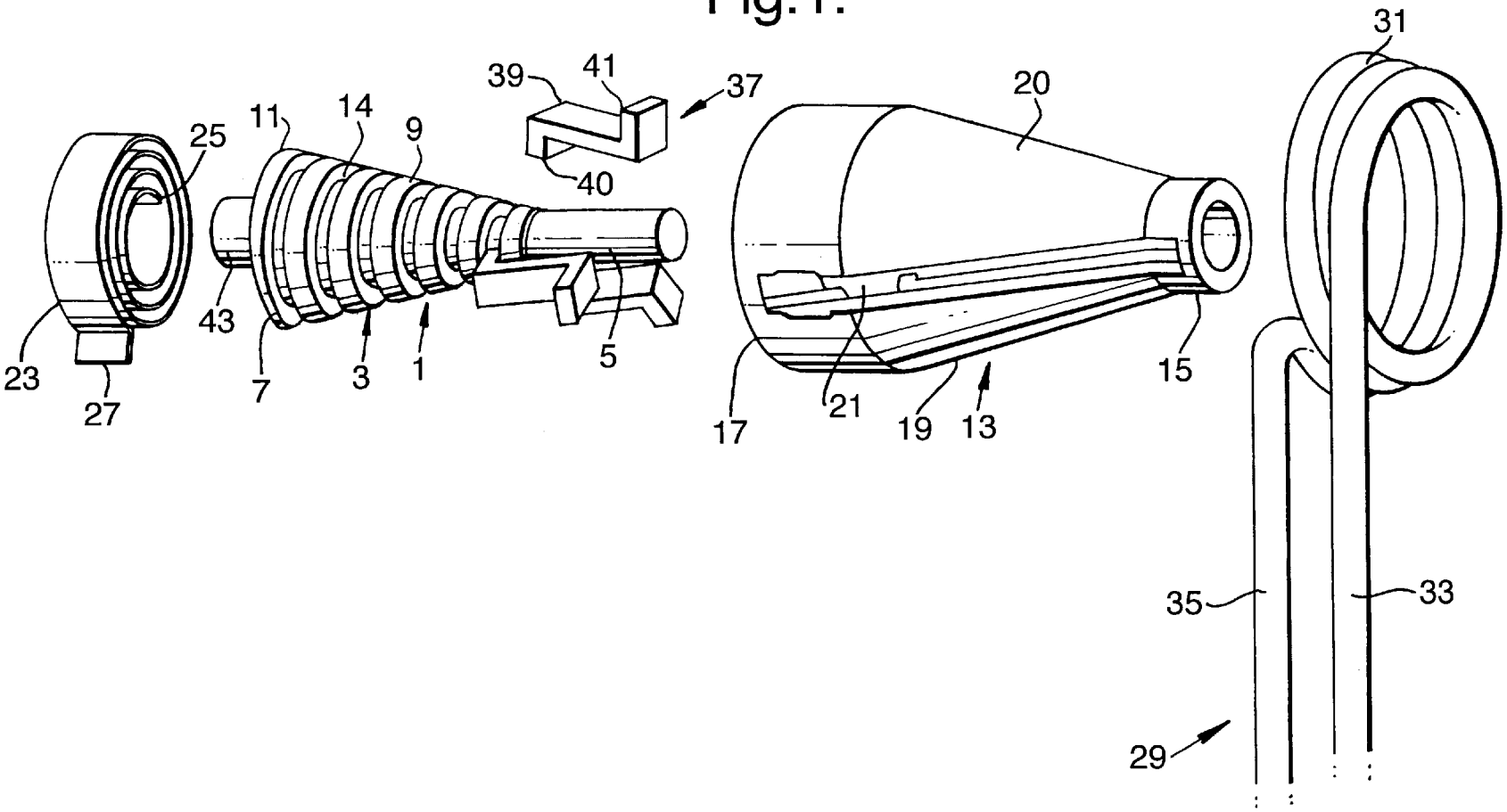
FIG. 1 is an exploded view of a first embodiment of a cord spool of this invention for a Venetian blind.

As best seen from FIG. 1, the cord spool 1 includes an inner longitudinally-extending cone 3 nested within an outer longitudinally-extending cone 13 along the longitudinal axis of the cord spool 1. The cord spool also includes a coil spring 23, an operating cord 29 and means 37 for pushing the operating cord 29 longitudinally.

The inner cone 3 of the cord spool 1 has a right first longitudinal end 5 of a first, relatively small, lateral diameter, a left second longitudinal end 7 of a second, relatively large, lateral diameter and a longitudinally-extending intermediate section 9 connecting the two ends 5, 7. The lateral diameter of the intermediate section 9 gradually increases from the diameter of the first end 5 to the diameter of the second end 7. The outer surface 11 of the inner cone 3 has a continuous circumferential thread 14 which advances in a counter-clockwise, right-to-left direction as shown in FIG. 1.

The outer cone 13 of the cord spool 1 has a right first longitudinal end 15 of a first, relatively small, lateral diameter, a left second longitudinal end 17 of a second, relatively large, lateral diameter and a longitudinally-extending intermediate section 19 connecting the two ends 15, 17. The lateral diameter of the intermediate section 19 gradually increases from the diameter of the first end 15 to the diameter of the second end 17. The outer cone 13 has a smooth outer surface 20 and a hollow interior which can accommodate the inner cone 3. At least one longitudinally-extending slit 21, preferably a plurality of circumferentially spaced, longitudinally-extending slits 21, is provided in the intermediate section 19 of the outer cone 13. Preferably, each slit 21 extends through the outer cone 13 from its first end 15 to its second end 17 and communicates with its hollow interior and its outer surface 20.

The inner cone 3 is inserted co-axially in the outer cone 13, with the first ends 5, 15 of the cones 3, 13 adjacent to one another and the second ends 7, 17 of the cones adjacent to one another. The inner and outer cones 3, 13 are rotatable about their common longitudinal axis.

The second ends 7, 17 of the two cones 3, 5 are connected by the coil spring 23 mounted about the longitudinal axis of the cord spool 1. An inner connection tab 25 of the coil spring 23 is connected to the second end 7 of the inner cone 3, and an outer connection tab 27 of the coil spring is connected to second end 17 of the outer cone 13. The coil spring 23 can be a conventional coil spring that, as shown in FIG. 1, is adapted to be wound or tightened by moving its outer tab 27 in a counter-clockwise direction relative to its inner tab 25 and unwound or loosened by moving its outer tab 27 in a clockwise direction relative to its inner tab 25. The coil spring 23 acts as a continuous variable coupling between the second ends 7, 17 of the inner and outer cone 3, 13, causing the inner cone 3 always to rotate about its longitudinal axis with rotation of the outer cone 13 about its longitudinal axis. In this regard, counter-clockwise rotation of the inner cone 3 will lag behind that of the outer cone 13 when the coil spring 23 is being tightened, and the inner cone will rotate clockwise relative to the outer cone when the spring is being loosened.

The operating cord 29 can be a conventional operating or pull cord, preferably a closed cord loop or the like. The operating cord 29 is wound at least once, preferably a plurality of times, circumferentially and counter-clockwise around the outer surface 20 of the outer cone 13 and thereby about the longitudinal axis of the cord spool 1 as shown in FIG. 1. The resulting coil(s) 31 of the operating cord 29 have their two ends 33, 35 on laterally opposite sides of the outer cone 13. Each end 33, 35 of the coil(s) can be pulled downwardly as described below, to rotate the outer cone 13 about its longitudinal axis and thereby raise or lower the Venetian blind (not shown). In this regard, the front end 33 of the coil(s) 31 of the operating cord 29, as shown in FIG. 1, can be pulled downwardly to raise or open the Venetian blind, and the rear end 35 of the coil(s) 31 of the operating cord 29, as shown in FIG. 1, can be pulled downwardly to lower or close the Venetian blind as described in detail below.

The means 37 for pushing the operating cord 29 longitudinally includes a following part, generally 39, slidably movable along the thread 14 in the outer surface 11 of the inner cone 3. Preferably, the following part 39 has a lower part or foot 40 which fits loosely within the thread 14 on the outer surface 11 of the inner cone 3 and can easily move circumferentially within the thread about the inner cone. A radially-extending pusher tab 41 is mounted on the foot 40 of the following part 39 and extends through and outwardly of one of the longitudinally-extending slits 21 in the outer cone 13. In this regard, each pusher tab 41 must be of sufficient radial length to protrude outwardly of the slit 21 in the outer cone 13 at the ends 15, 17, as well as along the entire length of the intermediate section 19, of the outer cone. Preferably, a plurality of circumferentially spaced, following parts 39, each with a foot 40 and a pusher tab 41, are threaded on the outer surface 11 of the inner cone 3, each with its foot 40 inserted in the thread 14 in the outer surface 11 of the inner cone 3 at a different circumferential location and each with its pusher tab 41 extending radially outwardly of the outer cone 13 through a different one of slits 21. Thereby, the pusher tabs 41 are adapted to push smoothly and evenly the coil(s) 31 of the operating cord 29 longitudinally along the entire length of the outer surface 20 of the outer cone 13.

The pushing means 37 and its following part 39, the thread 14 in the outer surface 11 of the inner cone 3, and the slits 21 in the outer cone 13 are preferably dimensioned so as to exert as little friction as possible when they move relative to one another. These parts can also be lubricated by conventional solid or liquid lubricants and/or manufactured from low friction plastics or with low friction coatings. It is also preferred that the pitch of the thread 14 of the inner cone 3 be relatively flat in order to make it easy for the foot 40 of each following part 39 to move longitudinally within the thread, when the pusher tab 41 of the following part is urged to move circumferentially about the inner cone 3 by circumferential movement of its slit 21 about the outer cone 13 as described below.

The second longitudinal end 7 of the inner cone 3 is fixedly connected to a conventional longitudinally-extending rotatable central shaft 43 of the blind (not shown). In this regard, the inner cone 3 and the central shaft 43 can, if desired, be made as one piece. In any case, the longitudinal axes of the inner cone 3 and the central shaft 43 are preferably co-linear. Thereby, rotation of the inner cone 3 about its longitudinal axis with rotation of the outer cone causes the central shaft 43 also to rotate about its longitudinal axis. The central shaft 43 preferably has a polygonal (e.g., hexagonal) cross-section, but can also be round in cross-section.

A mono-command mechanism (not shown) can be connected to the central shaft 43 for controlling the retraction and deployment of the blind. The mono-command mechanism would be located to the left of the cord spool 1 as shown in the figures and described herein. Suitable mono-command mechanisms are known, for example, from U.S. Pat. Nos. 5,228,491, 3,352,349, 2,737,235 and 4,697,630.

Figure 2:
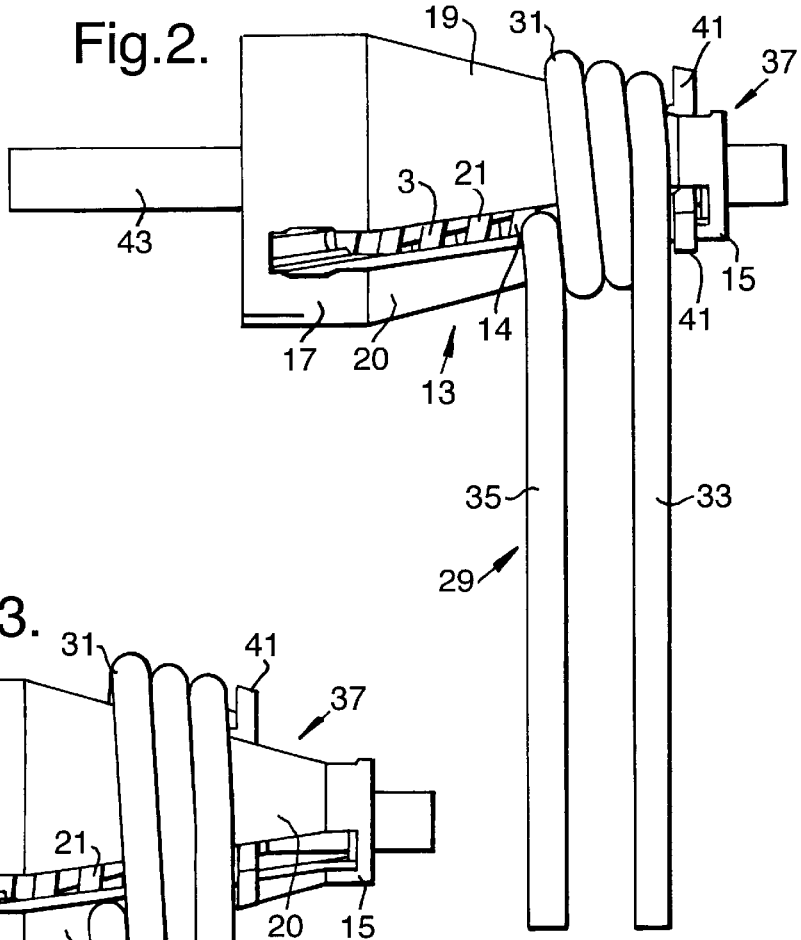
FIG. 2 is a side view of the fully assembled, cord spool of FIG. 1 when the blind would be completely lowered and ready to be raised.
Figure 3:
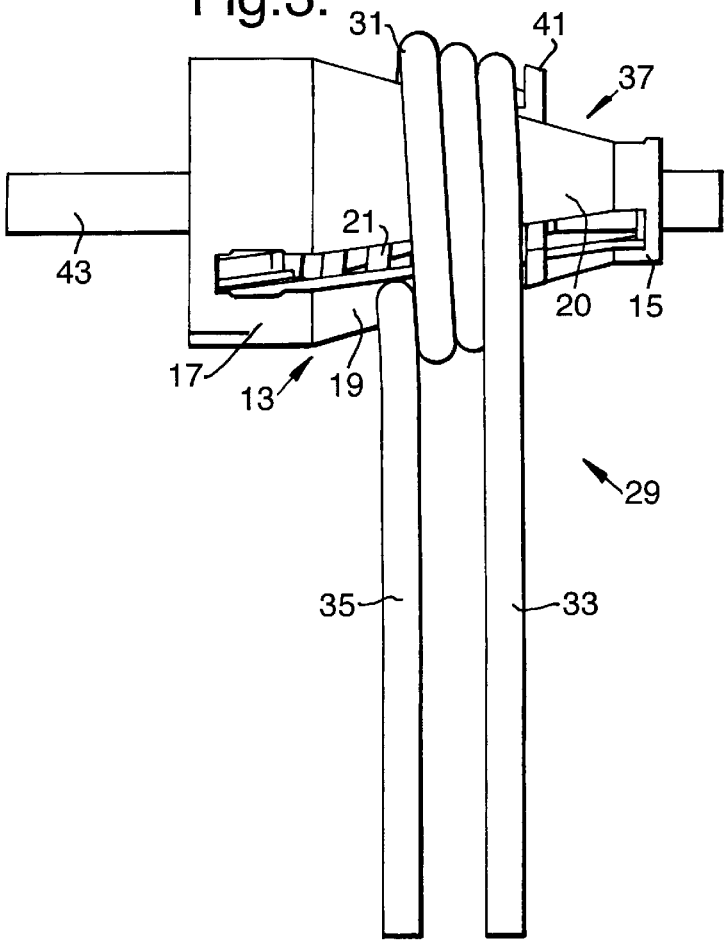
FIG. 3 is a side view of the cord spool of FIG. 1 when the blind would be partly raised.
Figure 4:
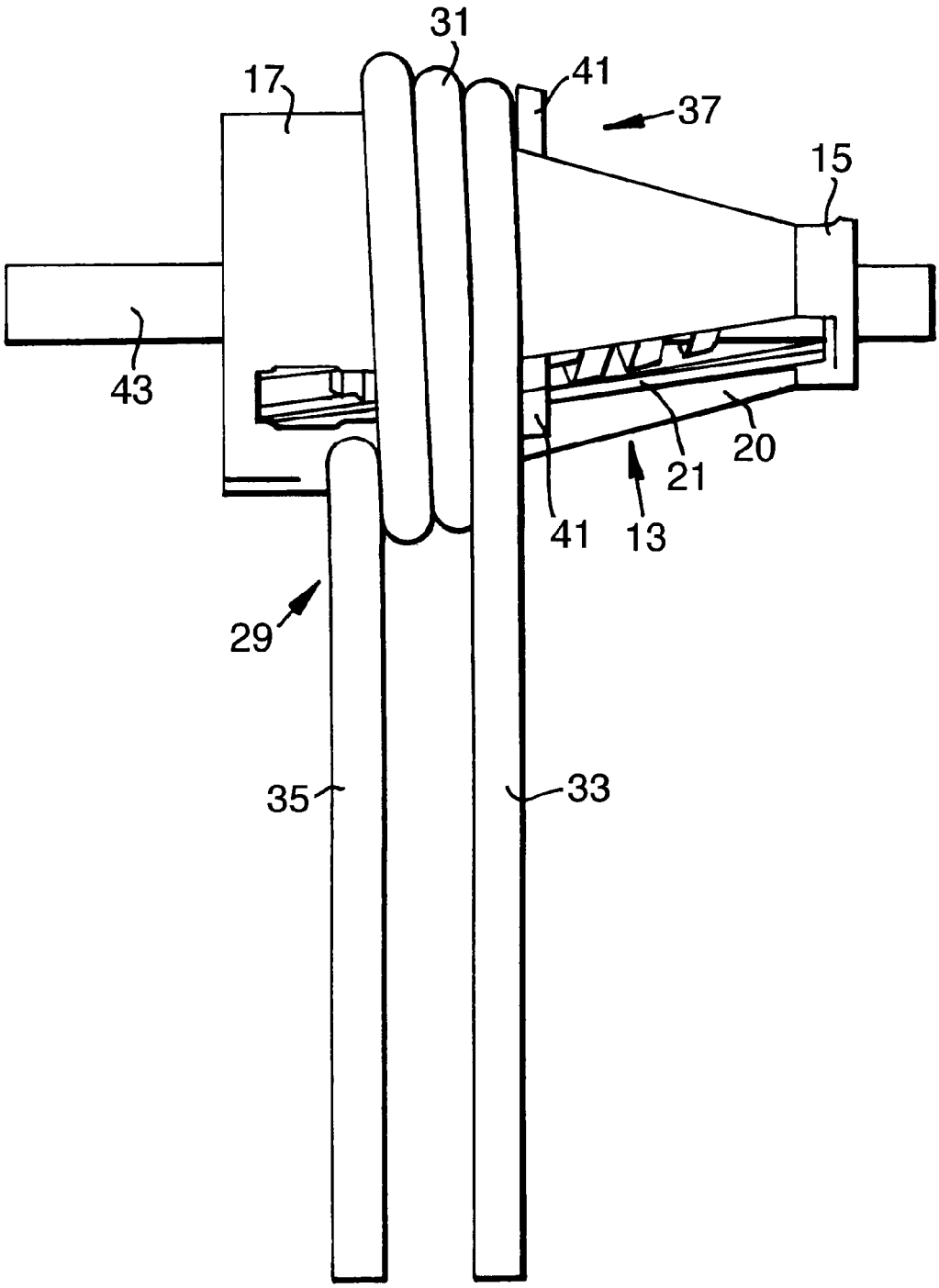
FIG. 4 is a side view of the cord spool of FIG. 1 when the blind would be completely raised.

FIGS. 2–4 show schematically the operation of the cord spool 1 for raising or opening a conventional Venetian blind (not shown).

FIG. 2 shows the cord spool 1 when the blind is completely lowered—before the front end 33 of the coil(s) 31 of the operating cord 29 has been pulled downwardly in order to raise the blind. In this Figure, the coil(s) 31 of the operating cord 29 are wound around the intermediate section 19 of the outer cone 13 near its right first end 15. The pusher tab 41 of the following part 39 projects outwardly of the outer cone 13 through the slit 21, to the right of the coil(s) 31 of the operating cord and to the left of the right first end 15 of the outer cone 13. The thread 14 on the outer surface 11 of the inner cone 3, within the outer cone 13, is visible through the slit 21.

FIG. 3 shows the cord spool 1 when the blind is raised half way–with the coil(s) 31 of the operating cord 29 wound around the longitudinal middle of the intermediate section 19 of the outer cone 13. The pusher tab 41 of the following part 39 projects outwardly of the outer cone 13 through the slit 21 in the intermediate section 19, just to the right of the coil(s) 31 of the operating cord.

FIG. 4 shows the cord spool 1 when the blind is completely raised—with the coil(s) 31 of the operating cord 29 wound around the intermediate section 19 of the outer cone 13 near its left second end 17. The pusher tab 41 of the following part 39 projects outwardly of the outer cone 13 through the slit 21 in the intermediate section 19, just to the right of the coil(s) 31 of the operating cord, near the left second end 17 of the outer cone.

Raising the blind (not shown) to open it is shown in FIGS. 2 to 4.

In FIG. 2, the weight of the bottom rail (not shown) exerts a force, F(blind), on the central shaft 43 of the blind (not shown), and a pulling force, F(pull), of a person raising the blind acts on the central shaft through the operating cord 29, the outer cone 13, the coil spring 23 and the inner cone 3 of the cord spool 1 of this invention. These forces translate into two counter-directed variable torques acting on the central shaft 43. One torque, T(blind), equals F(blind) times the constant radial distance, d(blind), from the longitudinally-extending central axis of the central shaft 43 to its surface. The second torque, T(pull), equals F(pull) times the variable radial distance, d(pull), from the central axis of the central shaft 43 to the operating cord 29. In this regard, d(pull) is variable in the cord spool 1 since d(pull) depends on the radius of the operating cord 29 at its longitudinal location on the outer cone 13. A variable d(pull) is necessary in the cord spool 1 to provide the blind with a relatively constant F(pull),so that a person pulling on the operating cord 29 will not feel F(blind) increasing as the blind is being raised.

The coil spring 23, which acts as a variable coupling means between i) the inner cone 3 (and thus the central shaft 43) and ii) the outer cone 13, has an inherent tightness, IT(coil). For this reason, the coil spring 23 will resist being either i) wound or tightened or ii) unwound or loosened—until its IT(coil) is overcome by the difference between T(blind) and T(pull). For the cord spool 1 to be used to raise the blind, two conditions must be met: i) T(pull) must be greater than T(blind), and ii) IT(coil) of the coil spring 23 must couple the inner cone (and thus the central shaft 43) to rotate with the outer cone 13 when the front end 33 of the coil(s) 31 of the operating cord 29 is pulled downwardly. For the coil spring 23 to actuate automatically means in the cord spool to prevent or regulate an F(pull) gradient when raising the blind, the coil spring has to be chosen such that its IT(coil) will be intermittently less than T(blind) minus T(pull) during the raising of the blind, although IT(coil) will increase as the coil spring 23 is tightened during the raising of the blind. For example, if an extremely tight coil spring 23 is chosen, it will act as a fixed coupling between the two cones 3, 13, and a person pulling on the operating cord will experience an F(pull) gradient because the coil spring will not be wound or tightened as the blind is raised. Likewise, if an extremely loose coil spring 23 is chosen, it will never act as a coupling between the two cones 3, 13, and the blind will not be raised because the coil spring will unwind or loosen as the operating cord is pulled. However, between these extremes, it is not necessary to choose a different coil spring 23 for different sizes and weights of blinds, to be used with the cord spool 1.

As the blind is raised (from its position in FIG. 2) by pulling downwardly on the front end 33 of the coil(s) 31 of the operating cord 29, initially: T(pull) is greater than T(blind) and IT(coil) is great enough to couple the inner and outer cones 3, 13 in rotation. Hence, the inner cone 3, connected by the coil spring 23 to the outer cone 13, rotates counter-clockwise (as viewed from the right side of FIGS. 2–4) together with the outer cone. This causes the central shaft 43, which rotates with the inner cone 3, to rotate initially counter-clockwise together with the outer cone 13. In this regard, T(pull) causes the outer cone 13 to rotate counter-clockwise, due to the friction exerted by the coil(s) 31 of the operating cord 29 on the outer surface 20 of the outer cone. As a result, the coil spring 23 is not wound or tightened (i.e., its outer tab 27 does not rotate counter-clockwise relative to its inner tab 25), the pushing means 37 does not move longitudinally so as to move the operating cord 29 longitudinally, and as the inner cone 3 rotates counter-clockwise with the outer cone 13, the central shaft 43 also rotates counter-clockwise to raise the blind.

As the blind is raised further (for example from its position in FIG. 2 to its position in FIG. 3) by pulling further downwardly on the front end 33 of the operating cord 29, the upwardly moving bottom rail (not shown) lifts more and more of the slats (not shown) of the blind off of the ladder tapes (not shown), supporting them, whereby such slats come to rest atop the bottom rail. As a result, the weight of these slats is added progressively to the weight of the bottom rail and exerts an increasing T(blind) on the central shaft 43 of the blind. As T(blind) increases, it becomes so much greater than T(pull) that IT(coil) of the coil spring 23 can no longer maintain the coupled rotation of the inner and outer cones 3, 13. In this situation, the inner cone 3 rotates counter-clockwise (in FIGS. 2–4) somewhat slower than the outer cone 13. This lag in the counter-clockwise rotation of the inner cone 3, relative to the outer cone13, causes the coil spring 23, whose inner and outer tabs 25, 27 continuously connect the inner and outer cones 3, 13, to wind and tighten, although the blind continues to be raised by the somewhat slower counter-clockwise rotation of the central shaft 43 and the inner cone 3. As the coil spring 23 winds and tightens due to the increasing difference in the two torques, T(blind) and T(pull), IT(coil) increases to a new IT(coil). The counter-clockwise rotation of the outer cone 13 relative to the inner cone 3 also causes the slits 21 in the outer cone to urge the pusher tabs 41 of the following parts 39, within the slits, to move counter-clockwise. As a result, the foot 40 of each following part 39 glides, preferably almost without friction, counter-clockwise and also longitudinally to the left (in FIGS. 2–4) along the thread 14 in the outer surface 11 of the inner cone 3. Thereby, its radially-extending pusher tab 41 also moves the coil(s) 31 of the operating cord 29 longitudinally to the left along the outer surface 20 of the outer cone 13, within its intermediate section 19. As the operating cord 29 is moved to a more leftward part of the outer cone 13 with a larger diameter, d(pull) increases. As d(pull) increases, so does T(pull).

This increase of d(pull) and thereby T(pull) continues until: T(pull) is again at least somewhat greater than, and certainly no less than T(blind); and IT(coil) no longer increases because T(blind) no longer exceeds T(pull); but IT(coil) is sufficiently strong to couple the two cones 3, 13 to rotate together. Because only d(pull) increases while F(pull) remains constant, the person pulling the operating cord 29 downwardly will experience little or no force gradient. Since in this new dynamic balance, T(pull) is again greater than T(blind) and the new IT(coil) of the coil spring 23 is strong enough to continuously connect the inner and outer cones, they rotate counter-clockwise together. As a result, the coil spring 23 is not wound or tightened further as the blind is raised further.

As the blind is raised still further by pulling downwardly on the front end 33 of the operating cord 29, still more of its slats come to rest on the upwardly moving bottom rail. As T(blind) again increases, it becomes so much greater than T(pull) that the new IT (coil) can again no longer maintain the coupled rotation of the inner and outer cones 3, 13. This causes the inner cone 3 again to rotate counter-clockwise (in FIGS. 2–4) somewhat slower than the outer cone 13, thereby further winding and tightening the coil spring 23. As a result d(pull) increases again as the slits 21 in the outer cone 13 urge the pusher tabs 41 of the following parts 39 to move counter-clockwise, causing the feet 40 to slide counter-clockwise and longitudinally more to the left (in FIGS. 2–4) along the thread 14 in the outer surface 11 of the inner cone 3, so as to move the pusher tabs 41 and thereby the operating cord 29 longitudinally to the left along the outer surface 20 of the outer cone 13 to a more leftward part of the outer cone with a larger diameter—until a new dynamic balance is reached when T(pull) is again at least slightly greater than T(blind) and another new IT(coil) continuously connects the inner and outer cones, so that they rotate counter-clockwise together. As a result, the coil spring 23 is not wound or tightened still further as the blind is raised still further.

This cycle is repeated until the blind is completely raised (in FIG. 4). The steps in the cycle of winding and tightening the coil spring 23, of increasing IT(coil) and of the pusher tabs 41 moving the operating cord 29 longitudinally to the left along the outer surface 20 of the outer cone 13, resulting in an increasing T(pull), are almost infinitesimally small. The result is a process of raising the blind—with little or no force gradient for F(pull)—that seems continuous. In this regard, the coil spring 23 acts as a variable coupling means which: i) continuously and automatically engages the inner and outer cones 3, 13, so that they rotate together when T(pull) is greater than T(blind); and ii) somewhat disengages them so that the inner cone 3 rotates counter-clockwise (in FIGS. 2–4) somewhat slower than the outer cone 13 when IT(coil) is overcome by T(blind) minus T(pull). This lag in the counter-clockwise rotation of the inner cone 3, relative to the outer cone 13, causes the coil spring 23, whose inner and outer tabs 25, 27 continuously connect the inner and outer cones 3, 13, to wind and tighten intermittently to new IT(coil)s, although the blind continues to be raised by the somewhat slower counter-clockwise rotation of the central shaft 43 and the inner cone 3. The rotation of the outer cone relative to the inner cone, also causes the pusher means 37 and the coil(s) 31 of the operating cord 29 to move to the left along the outer cone 13.

Lowering the blind (not shown) to close it is shown in FIGS. 4 to 2. The process of lowering the blind is essentially the reverse of the process, just described, for raising the blind and involves simply lowering fully the head rail (not shown), whereby the coil spring 23 unwinds and loosens, which causes the pushing means 37 to be moved longitudinally to the right as a result of the clockwise rotation of the outer cone 13 relative to the inner cone 3 and the operating cord 29 slides longitudinally back to the right under its own weight.

Figure 5:
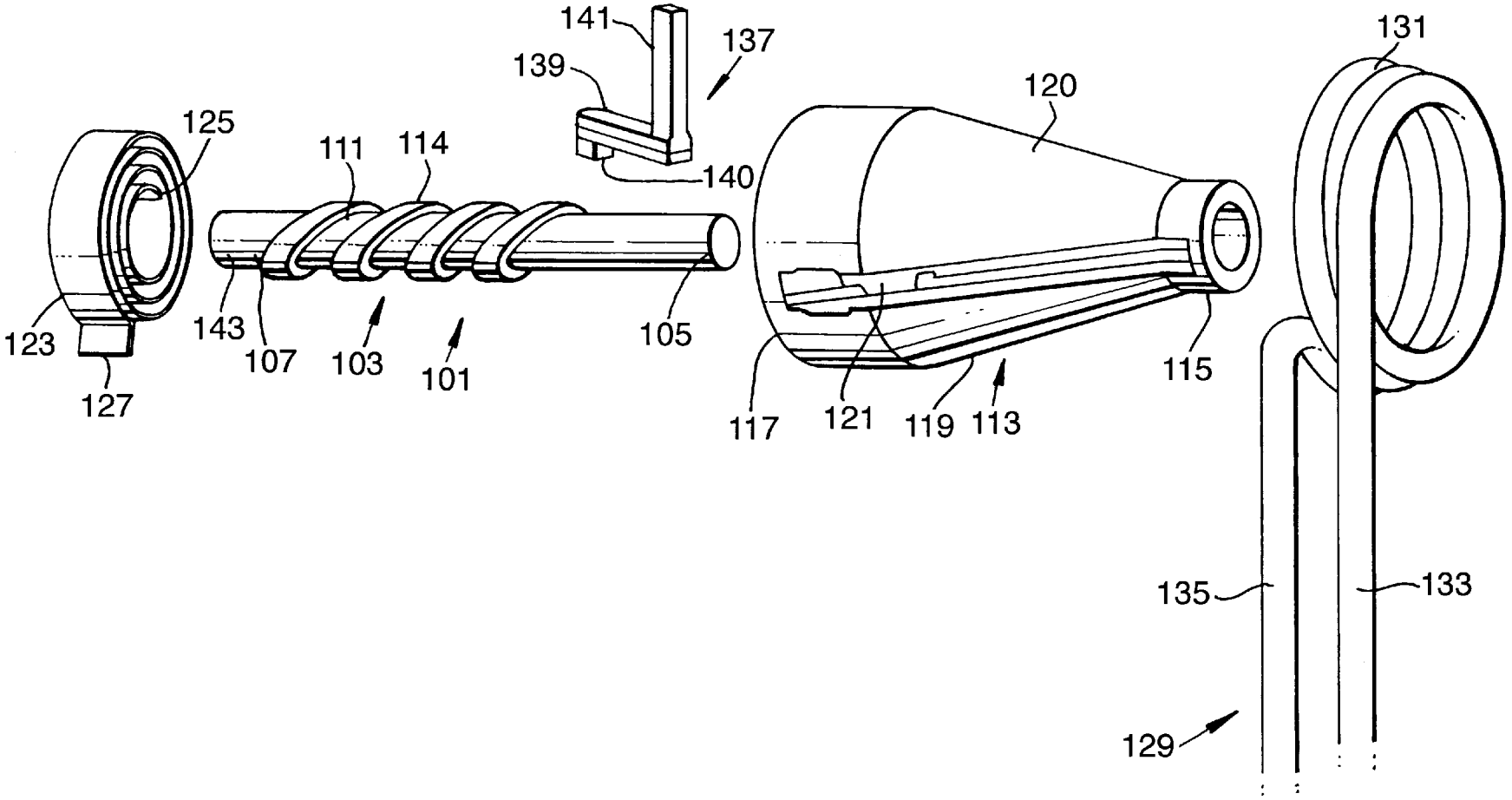
FIG. 5 is an exploded view of a second embodiment of a cord spool of this invention for a Venetian blind.

FIG. 5 shows a second embodiment of a cord spool 101 of the invention which is similar to the cord spool 1 of FIGS. 1–4 and for which corresponding reference numerals (greater by 100) are used below for describing the same parts or corresponding parts.

The cord spool 101 includes an inner longitudinally-extending rotatable rod or shaft 103 within an outer longitudinally-extending rotatable cone 113. The cord spool 101 also includes a coil spring 123, an operating cord 129 and means 137 for pushing the operating cord 129 longitudinally.

The inner rod 103 of the cord spool 101 has a right first end 105, a left second end 107 and a longitudinally-extending intermediate section connecting the two ends. The outer surface 111 of the inner rod 103 has a continuous circumferential thread 114 which advances in a counter-clockwise, right-to-left direction as shown in FIG. 5. The second end 107 of the inner rod 103 is connected to a central shaft 143 of a Venetian blind (not shown).

The outer cone 113 of the cord spool 101 has a right first longitudinal end 115 of a first, relatively small, lateral diameter, a left second longitudinal end 117 of a second, relatively large, lateral diameter, and a longitudinally-extending intermediate section 119 connecting the two ends 115,117. One or more longitudinally-extending slits 121 are provided in the intermediate section 119 of the outer cone 113.

The inner rod 103 is inserted in the outer cone 113 with their first ends 105, 115 adjacent to one another. A coil spring 123, within the outer cone 113, has its inner connection tab 125 connected to the second end 107 of the inner rod 103 and its outer connection tab 127 connected to the second end 117 of the outer cone 113. The coil spring 123 can be tightened by counter-clockwise rotation of its outer tab 127 relative to its inner tab 125 and loosened by the opposite rotation.

The operating cord 129 of the cord spool 101 is wound circumferentially around the outer surface 120 of the outer cone 113. The resulting coil(s) 131 of the operating cord 29 have their two ends 133, 135 on laterally opposite sides of the outer cone 113.

The means 137 for pushing the operating cord 129 longitudinally includes a following part 139, slidably movable along the thread 114 in the outer surface 111 of the inner rod 103. Preferably, the following part 139 has a foot 140 which fits loosely within the thread 114 on the outer surface 111 of the inner rod 103 and can easily move circumferentially within the thread about the inner rod. A radially-extending pusher tab 141 is mounted on each following part 139, extending through and outwardly of one of the longitudinally-extending slits 121 in the outer cone 113. In this regard, each pusher tab 141 must be of sufficient radial length to protrude outwardly of the slit 121 in the outer cone 113, through which the tab extends, all the way from the first end 115 to the second end 117 of the outer cone. Preferably, a plurality of circumferentially spaced, following parts 139 are threaded on the outer surface 111 of the inner rod 103. In this regard, the plurality of forming parts 139 could be formed as a rotatable nut (not shown) that is threaded on to the outer surface 111 of the inner rod 103 and that would have several pusher tabs 141 at different circumferential locations.

Figure 6A:
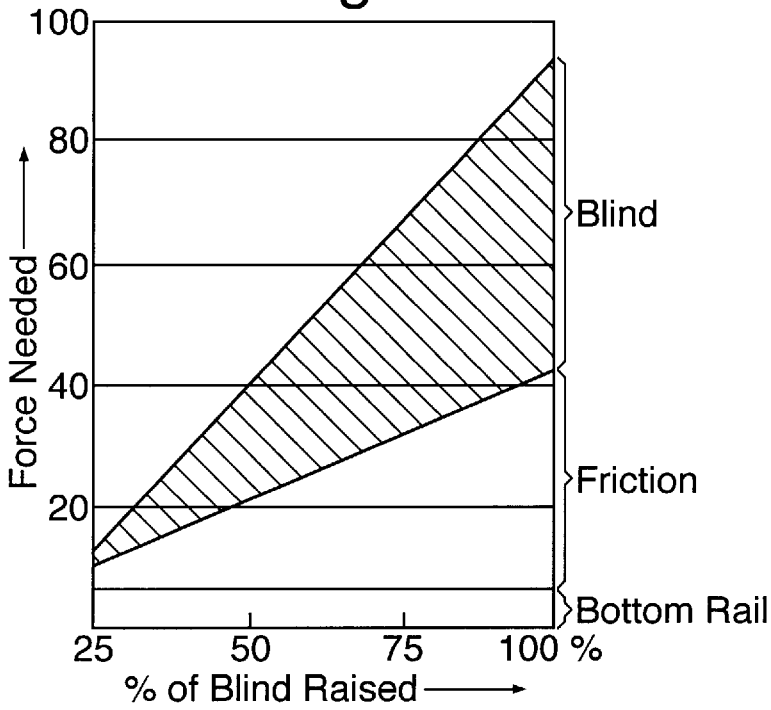
FIGS. 6A and 6B are graphs of the forces, estimated to be needed to lift a conventional blind without the cord spool of the invention (FIG. 6A) and with the cord spool of FIG. 1 or 5 (FIG. 6B) after different percentages of the blind have already been raised.

FIG. 6*a* shows a graph of the forces which are estimated to be needed to lift a conventional Venetian blind in relation to the percentage of the blind already raised. As can be seen from the graph, when less then 25% of the blind has been raised, the force needed to raise it further is mostly due to the weight of the bottom rail and some friction. When the blind has been further raised, the effect of the weight of the blind and of friction add substantially to the force needed to raise it still further, and the weight of the blind accounts for more than half of the force needed to raise the blind still further.

Figure 6B:
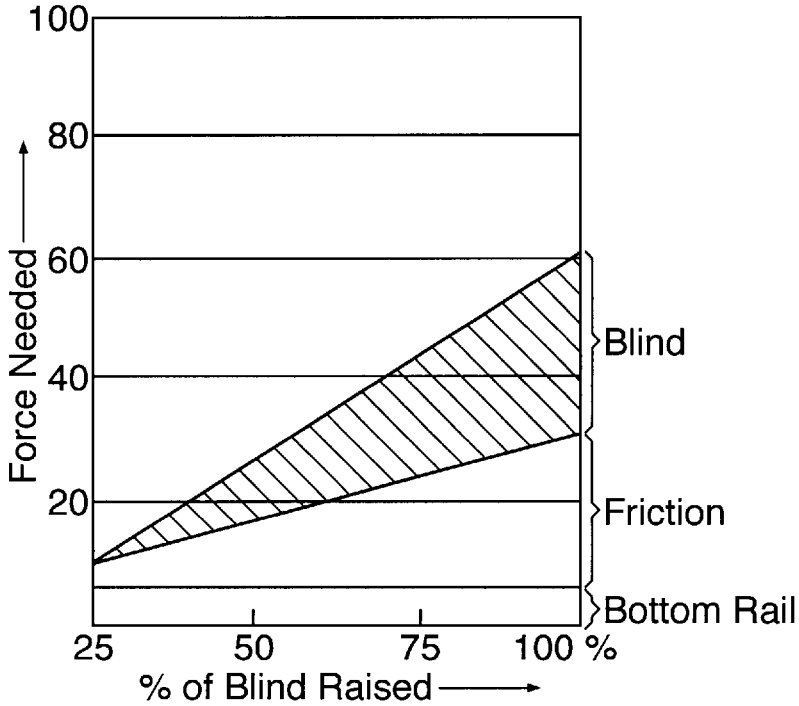

FIG. 6*b* shows a graph of the forces which are estimated to be needed to lift a Venetian blind with the cord spool 1 of FIG. 1. As shown, the cord spool 1 practically halves the force needed to raise the blind due to its weight and also reduces some of the friction in the blind. This results in a blind that can be more comfortably raised or lowered by a simple pull on its operating cord.

Figure 7A:
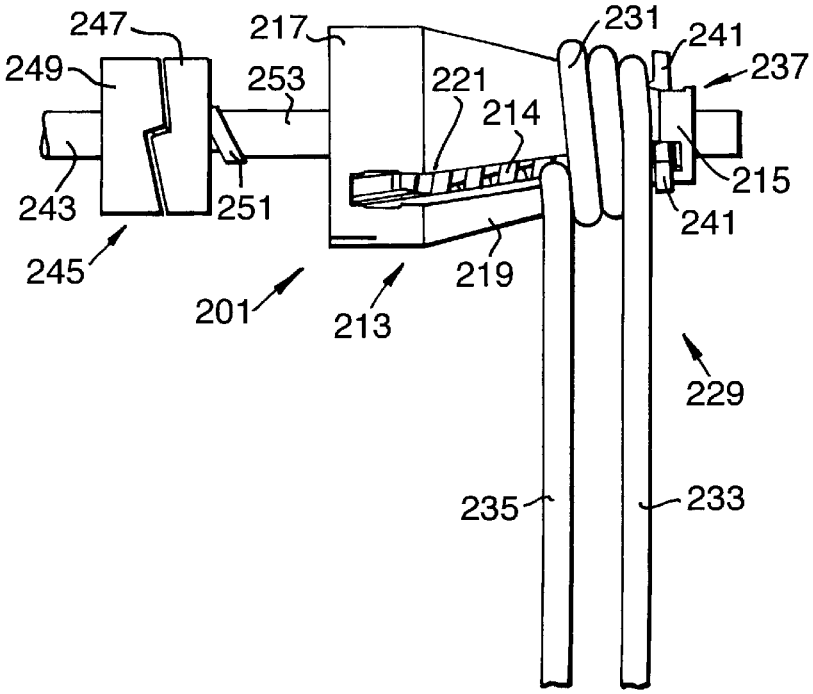
FIGS. 7A–7C show a third embodiment of a cord spool of this invention with an added clutch connecting the cord spool to the central shaft of a Venetian blind.
Figure 7B:
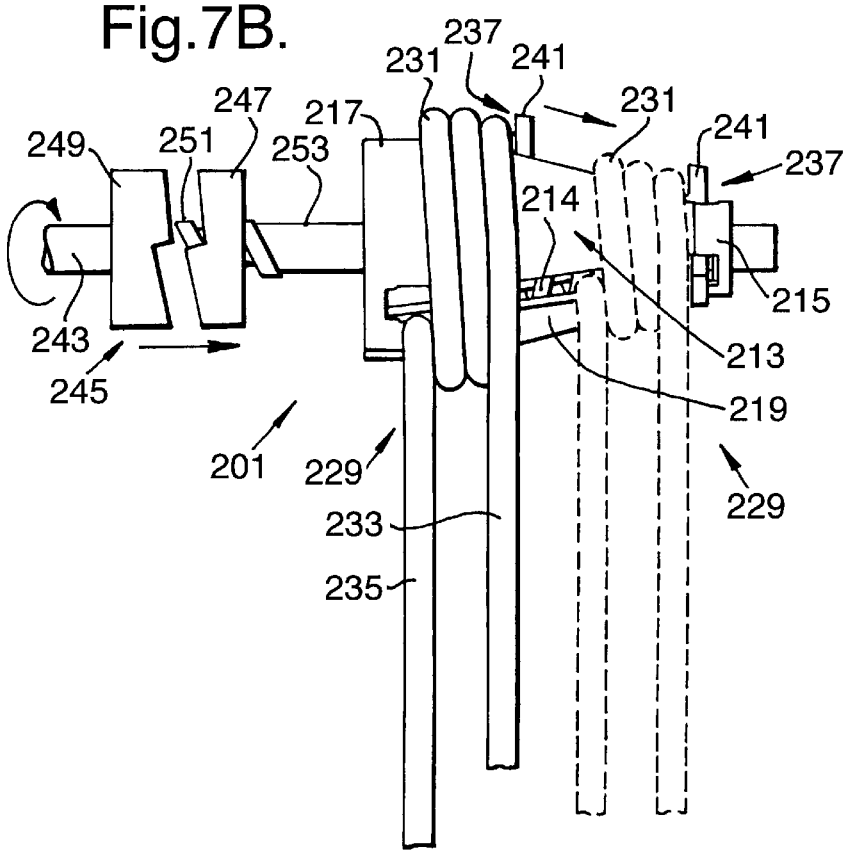
Figure 7C:
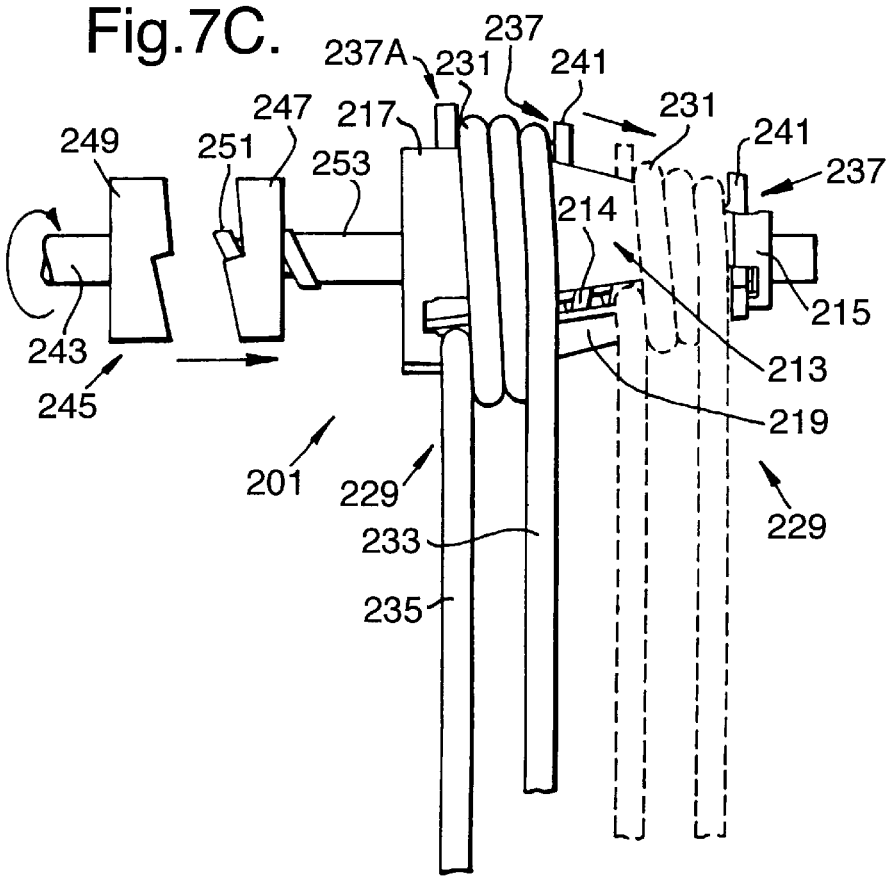

FIGS. 7A–C show a third embodiment of a cord spool 201 of the invention which is similar to the cord spool 1 of FIGS. 1–4 and for which corresponding reference numerals (greater by 200) are used below for describing the same parts or corresponding parts.

The cord spool 201 includes an inner longitudinally-extending rotatable cone 203 (not shown) nested within an outer longitudinally-extending rotatable cone 213. The cord spool 201 also includes: a coil spring 223 (not shown); an operating cord 229; and means 237 for pushing the operating cord 229 longitudinally. The inner cone 203 has: a right first end 205 (not shown) of a first, relatively small, lateral diameter; a left second end 207 (not shown) of a second, relatively large, lateral diameter; and a longitudinally-extending intermediate section 209 (not shown). The outer cone 213 has: a right first end 215 of a first, relatively small, lateral diameter; a left second end 217 of a second, relatively large, lateral diameter; and a longitudinally-extending intermediate section 219. The inner cone 203 is inserted co-axially in the outer cone 213, with the first ends 205, 215 of the cones 203, 213 adjacent to one another and the second ends 207, 217 of the cones adjacent to one another and connected by the coil spring 223.

The inner cone 203 (not shown) is connected to a clutch 245 such as is described, for example, in U.S. Pat. No. 4,427,050. In this regard, a right side 247 of the clutch 245 is rotatably and slidably mounted on, and engages, a circumferentially threaded, left portion 251 of a longitudinally-extending, clutch shaft 253. The thread on the left clutch shaft portion 251 advances in a counter-clockwise, left to right direction about the left portion 251. A right side of the clutch shaft 253 is connected to the second end 207 of the inner cone 203. A left side 249 of the clutch shaft 253 is fixedly connected to a central shaft 243 of a Venetian blind (not shown). The clutch shaft 253 and central shaft 243 are preferably in co-linear relation to each other.

When a front end 233 of the coil(s) 231 of the operating cord 229 is pulled downwardly to raise the blind, the two sides 247, 249 of the clutch 245 are meshed, and the inner cone 203, the clutch shaft 253 and the central shaft 243 rotate counter-clockwise together (as viewed from the right side of FIGS. 7A–7C). As a result, the cord spool 201 functions like the cord spools 1 and 101 of FIGS. 1–5 as described above when opening the blind.

When the blind has been partly or completely raised, a rear end 235 of the operating cord 239 can be pulled downwardly to lower the blind. This causes the two sides 247, 249 of the clutch 245 to disengage from one another as shown in FIG. 7B, whereby the right side 247 of the clutch, connected to the threaded portion 251 of the clutch shaft 253, spins longitudinally away from its left side 249. Once the two sides 247, 249 of the clutch 245 have become disengaged, the central shaft 243 can rotate freely of the cord spool 201, and the blind is no longer held up by the cord spool. The blind, therefore, drops under its own weight. At the same time, the coil spring 223 loosens and unwinds and thus urges the outer cone 213 to rotate clockwise relative to the inner cone 203. This, in turn, pushes the pushing means 237 longitudinally back to the right, to its starting point adjacent the first end 215 of the outer cone 213. The coil(s) 231 of the operating cord 229 slide longitudinally back to the right under their own weight (shown in dotted lines in FIG. 7B).

As shown in FIG. 7C, an extra pusher means 237A can be provided on the inner cone 203. The pusher means 237 is located adjacent the right side of the coil(s) 231 of the operating cord 229, and the extra pusher means 237A is located adjacent the left side of the coil(s) 231. As a result, the pusher means 237 and the extra pusher means 237A surround the coil(s) 231. Both pusher means 237 and 237A can slide along the thread 214 (not shown) of the inner cone 203 (not shown) in the same way, and they will move simultaneously and in the same direction when outer cone 213 rotates relative to inner cone 203. Thus, both pusher means will move longitudinally to the left along the thread 214 of the inner cone 203 towards the second end 217 of the outer cone 213 when the blind is raised, and they will move longitudinally to the right along the thread 214 towards the first end 215 of the outer cone 213 when the blind is lowered. When the blind is raised, the pusher means 237 pushes the coil(s) 231 to the left. When the blind is lowered, the extra pusher means 237A helps, along with the tendency of the coil(s) 231 to slide to the right under their own weight, to push the coil(s) to the right.

Figure 8:
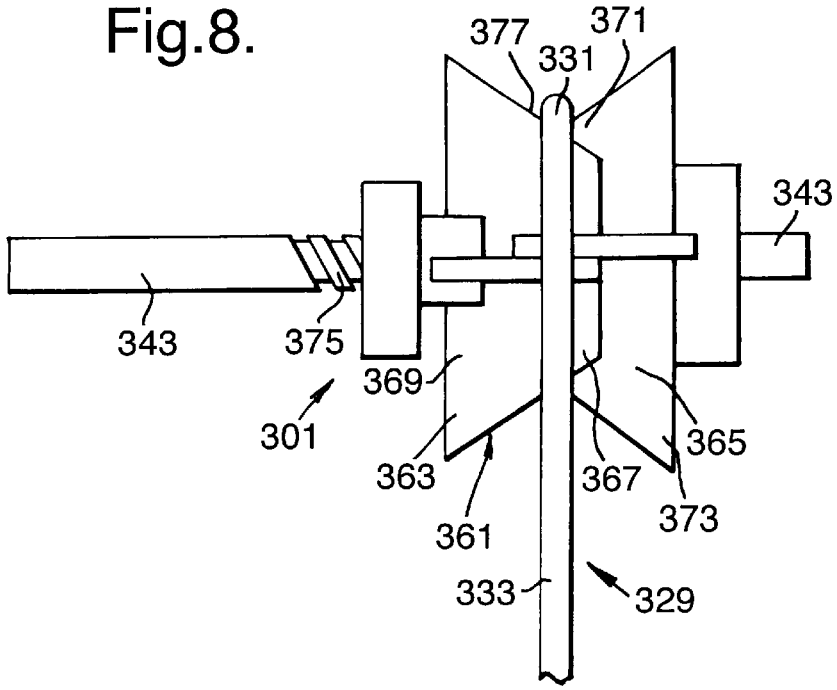
FIG. 8 shows schematically a fourth embodiment of a cord spool of this invention with a two-part diabolo-like part to prevent an F(pull) gradient.

FIG. 8 shows a fourth embodiment of a cord spool 301 of the invention which is similar to the cord spool 1 of FIGS. 1–4 and for which corresponding reference numerals (greater by 300) are used below for describing the same parts or corresponding parts.

The cord spool 301 includes a two-part diabolo, generally 361, in place of the inner and outer cones of FIGS. 1–5 and 7. The cord spool 301 also has a coil spring 323 (not shown) and an operating cord 329.

The two-part diabolo 361 has a left cone-like part 363 and a right cone-like part 365. The left cone-like part 363 has a right end 367 of a first, relatively small, lateral diameter, a left end 369 of a second, relatively large, lateral diameter, and a longitudinally-extending intermediate section between the two ends 367 and 369. The right cone-like part 365 has a left end 371 of a first, relatively small, lateral diameter, a right end 373 of a second, relatively large, lateral diameter, and a longitudinally-extending intermediate section between the two ends 371 and 373. The left cone-like part 363 is longitudinally slidable relative to the right cone-like part 365 which cannot move longitudinally. The cone-like parts 363, 365 of the two-part diabolo 361 each have conventional longitudinal slits which make it possible for one part 363 to slide into the other part 365. As a result, the right end 367 of the left part 363 can be slidably inserted into the left end 371 of the right part 365. Where the two cone-like parts 363,365 cross forms a gutter 377, in which coil(s) 331 of the operating cord 329 lie. The longitudinal distance by which the left part 363 is inserted into the right part 365, in combination with the slope of the cone-like parts, determine the diameter of the gutter 377.

Both cone-like parts 363, 365 are rotatably positioned around a central shaft 343 of a blind (not shown). The left part 363 engages a continuous circumferential thread 375 on the outer surface of the central shaft 343 (not shown). The thread 375 advances in a counter-clockwise, left to right direction about the central shaft 343. The cone-like parts 363, 365 rotate together and cannot rotate relative to each other. The left part 363 can slide longitudinally along the thread 375 on the central shaft relative to the right part 365 which cannot move longitudinally. The right part 365 is connected to the central shaft 343 by the coil spring 323 (not shown). In this regard, the right end 373 of the right part 365 is connected to the outer tab 327 of the coil spring 323, and the inner tab 325 of the coil spring 323 is connected to the central shaft 343. When the operating cord 329 is pulled, both cone-like parts rotate 363, 365, and if the coil spring 323 is tight enough to couple the left part 363 to the central shaft 343, the central shaft also rotates. If the central shafts lags behind in rotation, than the cone-like parts rotate in counter-clockwise direction somewhat faster than the central shaft, causing the left part 363 to move longitudinally to the right along the threaded part 375 of the central shaft.

Raising a blind with the cord spool 301 is effectuated by pulling the front end 333 of the operating cord 329 downwardly. In this regard, T(pull) causes the two-part diabolo 361 to rotate counter-clockwise (as viewed from the right side of FIG. 8), due to the friction exerted by the coil(s) 331 of the operating cord 329 on the surface of the gutter 377 between the left and right cone-like parts 363, 365 of the two-part diabolo. Initially, T(pull) is greater than T(blind, and IT(coil) of the coil spring 323 is great enough to couple the central shaft 343 of the blind to the two-part diabolo 361 so that they rotate together. As a result, the central shaft 343 also rotates counter-clockwise to raise the blind. The coil spring 323 is, however, not wound or tightened (i.e., its outer tab 327 does not rotate counter-clockwise relative to its inner tab 325).

As the blind is raised further by pulling further downwardly on the front end 333 of the operating cord 329, the upwardly moving bottom rail (not shown) of the blind lifts more and more of the slats (not shown) off of the ladder tapes (not shown), supporting them, whereby such slats come to rest atop the bottom rail. As a result, the weight of these slats is added progressively to the weight of the bottom rail and exerts an increasing T(blind) on the central shaft 343. As T(blind) increases, it reaches a point where T(blind) is greater than T(pull) and where IT(coil) can no longer maintain the coupled rotation of the central shaft 343 and the diabolo 361. In this situation, the central shaft 343 rotates counter-clockwise somewhat slower than the two-part diabolo 361. This causes the coil spring 323, whose inner and outer tabs 325, 327 continuously connect the two-part diabolo 361 to the central shaft 343, to wind and tighten, although the blind continues to be raised by the somewhat slower counter-clockwise rotation of the central shaft 343. As the coil spring 323 winds and tightens due to the difference between T(blind) and T(pull), IT(coil) increases. The counter-clockwise rotation of the two-part diabolo 361 relative to the central shaft also causes the left cone-like part 363 of the two-part diabolo to move to the right along the thread 375 on the outer surface of the central shaft 343. As the left cone-like part 363 moves to the right, it slides further into the right cone-like part 365. As a result, the cross-section of the gutter 377 between the two parts 363, 365 of the diabolo 361, around which the operating cord 329 is wound, becomes larger in diameter and d(pull) increases. As d(pull) increases, so does T(pull). The increase of d(pull) and thereby T(pull) continues until: T(pull) is again at least somewhat greater than, and certainly no less than, T(blind); and IT(coil) no longer increases because T(blind) no longer exceeds T(pull) and IT(coil) is sufficiently strong so that the coil spring 323 couples the central shaft 343 and the diabolo 361 to rotate counter-clockwise together and therefore is not wound or tightened further. Because only d(pull) increases while F(pull) remains constant, the person pulling the operating cord 329 downwardly will encounter little or no force gradient.

As the blind is raised still further by pulling downwardly on the front end 333 of the operating cord 329, still more of its slats come to rest on the upwardly moving bottom rail. As T(blind) again increases, it again reaches a new point where the difference between T(blind) and T(pull) is such that the new IT(coil) can no longer maintain the coupled rotation of the central shaft 343 and the diabolo 361. Since T(blind) has then increased, it is again slightly greater than T(pull), causing the central shaft 343 again to rotate counter-clockwise somewhat slower than the two-part diabolo 361 and thereby further winding and tightening the coil spring 323. As a result, d(pull) increases again as the left cone-like part 363 of the diabolo slides further into its right cone-like part 365, and the diameter of the gutter 377, around which the operating cord 329 is wound, increases—until T(pull) is again somewhat greater than T(blind) and another new IT(coil) is strong enough to continuously connect the central shaft 343 to the diabolo 361, so that they rotate counter-clockwise together and the coil spring 323 is not wound or tightened still further as the blind is raised still further.

This cycle is repeated until the blind is completely raised.

Figure 9:
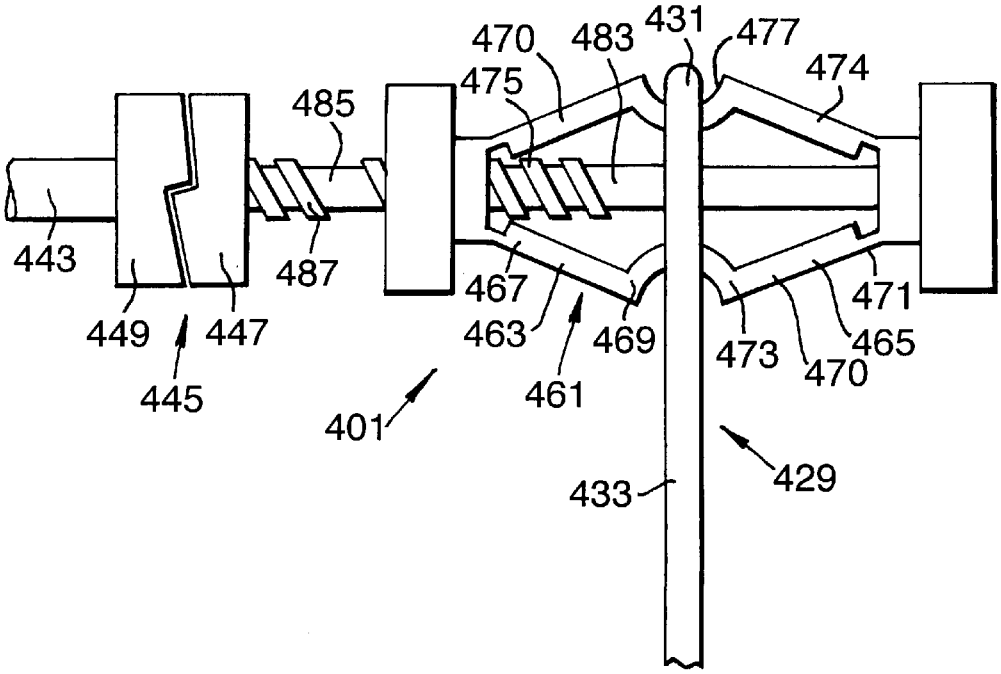
FIG. 9 shows schematically a fifth embodiment of a cord spool of this invention with an inverted two-sided diabolo-like part to prevent an F(pull) gradient.

FIG. 9 shows a fifth embodiment of a cord spool 401 of the invention which is similar to the cord spool 301 of FIG. 8 and for which corresponding reference numerals (greater by 100) are used below for describing the same parts or corresponding parts.

The cord spool 401 includes an inverted diabolo 461, in place of the two-part diabolo of FIG. 8. The cord spool 401 also has a coil spring 423 (not shown) and an operating cord 429.

The inverted diabolo 461 is a flexible tubular member, the longitudinal center of which can be radially expanded by moving the ends of the tubular member towards each other. The inverted diabolo 461 has: a left part or side 463 with a left end 467 of a first, relatively small, lateral diameter, a right end 469 which is at the center of the inverted diabolo 461 and can be radially expanded and spoke-like elements 470 connecting the two ends 467, 469; and a right part or side 465 with a right end 471 of a first, relatively small, lateral diameter, a left end 473 which is at the center of the inverted diabolo and can be radially expanded, and spoke-like elements 474 connecting the two ends 471, 473. The right end 469 of the left part 463 is hingedly connected to the left end 473 of the right part 465, and the two connected ends 469, 473 form an expandable circumferential gutter 477, around which the coil(s) 431 of the operating cord 429 are wound. In this regard, the inverted diabolo 461 can be compressed by longitudinal movement of its left part 463 towards its right part 465, causing the hinged connection between the two parts 463, 465 and the gutter 477 formed between them to expand radially outwardly.

The inverted diabolo 461 can be formed of a suitable plastic as one piece or can be formed of two separate parts 463, 465 which are connected by actual hinges.

The inverted diabolo 461 is positioned around a right portion 483 of a longitudinally-extending clutch shaft 485 that is connected to the right side 447 of a clutch 445, described below. The left side 449 of the clutch 445 is connected to a central shaft 443 of a Venetian blind (not shown). The clutch shaft 485 and central shaft 443 are preferably in co-linear relation to each other.

The left, inverted diabolo part 463 engages a continuous circumferential thread 475 on the outer surface of the right clutch shaft portion 483. The thread 475 advances in a counter-clockwise, left to right direction about the right clutch shaft portion 483. The left part 463 can slide longitudinally along the thread 475 on the right clutch shaft portion 483 relative to the right part 465 which cannot move longitudinally. The right part 465 is connected to the right clutch shaft portion 483 by a coil spring 423 (not shown). In this regard, the right end 471 of the right part 465 is connected to the outer tab 427 of the coil spring 423, and the inner tab 425 of the coil spring is connected to the right clutch shaft portion 483. When the operating cord 429 is pulled, both inverted diabolo parts 463, 465 rotate, and if the coil spring 423 is tight enough to couple the parts 463, 465 to the right clutch shaft portion 483 (subject to T(blind)), the right clutch shaft portion also rotates. If the right clutch shaft portion 483 lags behind the two inverted diabolo parts 463, 465 in rotation, than the inverted diabolo parts rotate in counter-clockwise direction somewhat faster than the right clutch shaft portion 483, and the left part 463 moves longitudinally to the right along the threaded part 475 of the right clutch shaft portion 483.

Raising the blind is effectuated by pulling a front end 433 of the operating cord 429. Initially, T(pull) is greater than T(blind), and IT(coil) is great enough to couple the right clutch shaft portion 483 and inverted diabolo 461 in rotation, so that they rotate counter-clockwise together (as viewed from the right side of FIG. 9), along with the central shaft 443 due to the clutch 445. In this regard, T(pull) causes the inverted diabolo 461 to rotate counter-clockwise, due to the friction exerted by the coil(s) 431 of the operating cord 429 on the surface of the gutter 477 of the hinged connected section between the left part 463 and the right part 465 of the inverted diabolo. Since IT(coil) of the coil spring 423 is great enough to continuously couple the right clutch shaft portion 483 and the inverted diabolo 461 and T(pull) is greater than T(blind), the inverted diabolo 461 and the right clutch shaft portion 483 rotate counter-clockwise together. As a result, the central shaft 443, connected to the clutch shaft 485 via the clutch 445, also rotates counter-clockwise to raise the blind, but the coil spring 423 is not wound or tightened (i.e., its outer tab 427 does not rotate counter-clockwise relative to its inner tab 425).

As the blind is raised further by pulling further downwardly on the front end 433 of the operating cord 429, the upwardly moving bottom rail (not shown) lifts more and more of the slats (not shown) of the blind off of the ladder tapes (not shown), supporting them, whereby such slats come to rest atop the bottom rail. As a result, the weight of these slats is added progressively to the weight of the bottom rail and exerts an increasing T(blind) on the right clutch shaft portion 483 of the blind. As T(blind) increases, it becomes greater than T(pull) so that IT(coil) of the coil spring 423 eventually can no longer maintain the coupled rotation of the right clutch shaft portion 483 and the inverted diabolo 461. As a result, the right clutch shaft portion 483 rotates counter-clockwise somewhat slower than the inverted diabolo 461. This causes the coil spring 423, whose inner and outer tabs 425, 427 continuously connect the inverted diabolo 461 to the right clutch shaft portion 483, to wind and tighten, although the blind continues to be raised by the somewhat slower counter-clockwise rotation of the clutch shaft 485. As the coil spring 423 winds and tightens while T(blind) is greater than T(pull), IT(coil) increases. The counter-clockwise rotation of the inverted diabolo 461 relative to the right clutch shaft portion 483 also causes the left, inverted diabolo part 463 to move longitudinally to the right along the thread 475 on the outer surface of the right clutch shaft portion 483. As the left part 463 moves to the right, the inverted diabolo 461 is compressed. As a result, the hinged connection of the left and right, inverted diabolo parts 463, 465, forming the gutter 477 around which the operating cord 429 is wound, becomes larger in diameter, and d(pull) increases. As d(pull) increases, so does T(pull). The increase of d(pull) and thereby T(pull) continues until: T(pull) is again at least slightly greater than T(blind); and IT(coil) no longer increases because T(blind) no longer exceeds T(pull) and IT(coil) is sufficiently strong so that it couples the right clutch shaft portion 483 and the diabolo 461 to rotate counter-clockwise together and the coil spring 423 is not further wound or tightened. Because only d(pull) increases while F(pull) remains constant, the person pulling the operating cord 429 downwardly will feel little or no force gradient.

As the blind is raised still further by pulling downwardly on the front end 433 of the operating cord 429, still more of its slats come to rest on the upwardly moving bottom rail. When T(blind) again increases until it becomes greater than T(pull), IT(coil) of the coil spring 423 will no longer be able to maintain the coupled rotation of the right clutch shaft portion 483 and the inverted diabolo 461, which will cause the clutch shaft 485 again to rotate counter-clockwise somewhat slower than the inverted diabolo 461, thereby further winding and tightening the coil spring. As a result d(pull) will increase again as the left, inverted diabolo part 463 slides further to the right, further compressing the inverted diabolo 461, and the diameter of the gutter 477, around which the operating cord 429 is wound, will increase—until T(pull) is again at least slightly greater than T(blind) and another new IT(coil) of the coil spring 423 is strong enough to continuously connect the right clutch shaft portion 483 to the inverted diabolo 461, so that they rotate counter-clockwise together and the coil spring 423 is not wound or tightened still further as the blind is raised still further.

This cycle is repeated until the blind is completely raised.

As also shown in FIG. 9, the right side 447 of the clutch 445 is rotatably and slidably mounted on, and engages, a circumferentially threaded, left portion 487 of the clutch shaft 485. The thread on the left clutch shaft portion 487 advances in a counter-clockwise, left to right direction about the left portion 487.

When a front end 433 of the operating cord 429 is pulled downwardly to raise the blind, the two sides 447, 449 of the clutch 445 are meshed, and the inverted diabolo 461, the clutch shaft 485 and the central shaft 443 rotate together. As a result, the cord spool 401 functions like the cord spools 1, 101, 201 and 301 of FIGS. 1–8 as described above when opening the blind.

When the blind has been partly or completely raised, a rear end 435 (not shown) of the operating cord 429 can be pulled downwardly to lower the blind. This causes the two sides 447, 449 of the clutch 445 to disengage from one another, whereby the right side 447 of the clutch, connected to the threaded left portion 487 of the clutch shaft 485, spins longitudinally away from its left side 449. Once the two sides 447, 449 of the clutch 445 have become disengaged, the central shaft 443 can rotate freely of the cord spool 401, and the blind is no longer held up by the cord spool. The blind, therefore, drops under its own weight. At the same time, the coil spring 423 loosens and unwinds and thereby urges the right, inverted diabolo part 465 to rotate clockwise about the clutch shaft 485. This, in turn, causes the left, inverted diabolo part 463 to rotate clockwise about the circumferential thread 475 on the right clutch shaft portion 483, so that the left part 463 moves back to the left, away from the right part 465 and thus decreases the diameter of the gutter 477, back to its original diameter. The cord spool 401 could, of course, also function without the clutch 445, in which case the clutch shaft 485 would be part of the central shaft 443.

Figure 10:
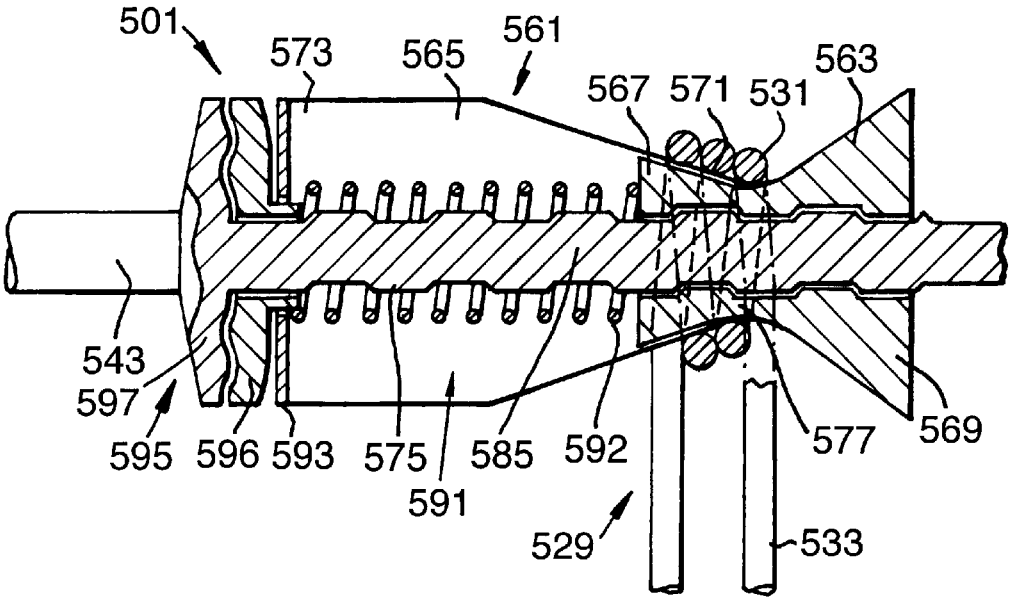
FIG. 10 shows schematically a sixth embodiment of a cord spool of this invention with a modified two-part diabolo-like part, together with a compression spring and a slipping clutch, to prevent an F(pull) gradient.

FIG. 10 shows a sixth embodiment of a cord spool 501 of the invention which is similar to the cord spool 301 of FIG. 8 and for which corresponding reference numerals (greater by 200) are used below for describing the same parts or corresponding parts.

The cord spool 501 includes a modified two-part diabolo, generally 561, with a right cone-like part 563 and a left cone-like part 565. The right cone-like part 563 has a left end 567 of a first, relatively small, lateral diameter, a right end 569 of a second, relatively large, lateral diameter, and a longitudinally-extending intermediate section between the two ends 567 and 569. The diameter of the right part 563 becomes smaller towards from its right end 569 to about its longitudinal middle and then increases from about its longitudinal middle to its left end 567. The left cone-like part 565 has a right end 571 of a first, relatively small, lateral diameter, a left end 573 of a second, relatively large, lateral diameter, and a longitudinally-extending intermediate section between the two ends 571 and 573. The diameter of the left part 565 is constant from its left end 573 to about its longitudinal middle and then decreases from about its longitudinal middle to its right end 571. The right part 563 is longitudinally slidable relative to the left part 565 which cannot move longitudinally. Each of the cone-like parts 563, 565 has conventional longitudinal slits which make it possible for the left end 567 of the right part 563 to slide into the right end 571 of the left part 565. Where the two parts 563, 565 cross forms an expandable circumferential gutter 577, around which the coil(s) 531 of the operating cord 529 are wound. The longitudinal distance by which the right part 563 is inserted into the left part 565, in combination with the slope of the cone-like parts, determines the diameter of the gutter 577.

Both cone-like parts 563, 565 are positioned around a threaded right portion 585 of a longitudinally-extending central shaft 543 of a blind (not shown). The thread 575 of the threaded portion 585 advances in a clockwise, right to left direction about the central shaft 543. The left half 597 of a two-piece slipping or friction clutch 595 is fixedly connected to the central shaft 543, to the left of its threaded portion 585, and preferably comprises a single piece with the central shaft. The right half 596 of the slipping clutch 595 is rotatably positioned around the central shaft 543, to the right of the left clutch half 597 and to the left of, and adjacent to, the left end of the threaded portion 585 of the central shaft. The right cone-like part 563 engages the continuous circumferential thread 575 on the outer surface of the threaded portion 585 of the central shaft. The left cone-like part 565, which is the outer cone, is mounted with its right side 571 on the right cone-like part 563, in such a way that right part 563 can slide into it. The left cone part 565 can rotate with the right cone part 563 about the threaded shaft portion 585 but the two cone parts cannot rotate relative to one another about the threaded shaft portion 585. When the cone-like parts rotate together about the threaded shaft portion 585, the right part 563 can move longitudinally along the thread 575 on the central shaft 543 and relative to the left part 565 which cannot move longitudinally.

Rotatably positioned around the threaded portion 585 of the central shaft 543 and within the modified diabolo 561 is a compression spring 591. The right end 592 of the compression spring is biased against the left end 567 of the right cone-like part 563, and the left end 593 of the compression spring is biased against the right half 596 of the slipping clutch 595. Thereby, the compression spring 591 biases the right clutch half 596 longitudinally into engagement with the left clutch half 597, but the two clutch halves can, nevertheless, rotationally slip relative to one another. When the longitudinal force of the compression spring 591 keeps the slipping clutch halves 596, 597 in engagement: the frictional engagement of the left end 593 of the spring with the right clutch half 596 and the attachment of the right end 592 of the spring to the left end 567 of the right cone-like part 563 will, in effect, rotatably couple the right clutch half and, thereby the left clutch half, to the right cone-like part 563; and as a result, the central shaft 543, that is fixedly connected to the left clutch half 597, will rotate with the modified diabolo 561.

Raising a blind with the cord spool 501 is effectuated by pulling the rear end 533 of the operating cord 529 downwardly. In this regard, T(pull) causes the modified diabolo 561 to rotate clockwise (as viewed from the right side of FIG. 10), due to the friction exerted by the coil(s) 531 the operating cord 529 on the surface of the gutter 577 between the right and left cone-like parts 563, 565 of the modified diabolo.

Initially, T(pull) is greater than T(blind), and the inherent tightness of the engagement of the slipping clutch halves 596, 597, IT(spring+clutch)—which is a function of the inherent sliding friction of the facing surfaces of the of the slipping clutch halves and of the longitudinal force exerted by the spring 591 on the right clutch half 596—is great enough to couple the central shaft 543 of the blind to rotate with the modified diabolo 561. As a result, the central shaft 543 also rotates clockwise to raise the blind. The spring 591 is, however, not further compressed or tightened, since the right cone-like part 563 does not rotate about the threaded portion 585 of the central shaft 543 and thus does not move to the left. Instead, the right cone-like part 563 rotates together with the central shaft 543.

As the blind is raised further by pulling further downwardly on the rear cord end 533, the upwardly moving bottom rail (not shown) of the blind lifts more and more of the slats (not shown) off of the ladder tapes (not shown), supporting them, whereby such slats come to rest atop the bottom rail. As a result, the weight of these slats is added progressively to the weight of the bottom rail and exerts an increasing T(blind) on the central shaft 543. As T(blind) increases, it reaches a point where T(blind) is greater than T(pull) and where IT(spring+clutch) can no longer keep the slipping clutch halves 596, 597 coupled together. As a result, the modified diabolo 561 rotates clockwise, together with the spring 591 and the right clutch half 596, somewhat faster than do the central shaft 543 and the left clutch half 597. The right clutch half 596 and the left clutch half 597 rotatably slip relative to each other. Since the pull force F(pull) on the rear cord end 533 continues, the cone-like parts 563, 565 continue to rotate clockwise but now rotate clockwise relative to the threaded shaft portion 585 and thus move to the left in FIG. 10.

When the right cone-like part 563 moves to the left, it compresses the spring 591 which increases IT(spring+clutch). This eventually results in renewed friction coupling between the slipping clutch halves 596, 597. This movement also results in the right cone-like part 563 sliding further into the left cone-like part 565, thereby increasing the diameter of the cross-section of the gutter 577 between the two parts 563, 565 of the modified diabolo 561, around which the operating cord 529 is wound. With the larger diameter of the gutter 577, d(pull) increases, thereby increasing T(pull). The increase of d(pull) and T(pull) continues until: T(pull) is again at least somewhat greater than T(blind); and IT(spring+clutch) no longer increases because T(blind) no longer exceeds T(pull) and IT(spring+clutch) is sufficiently strong to couple frictionally the slipping clutch halves 596, 597. The slipping clutch 595 then couples the central shaft 543 and the modified diabolo 561 to rotate clockwise together, and the right cone-like part 563 no longer slides to the left and does not further compress the spring 591 as the blind is raised further. Because only d(pull) increases while F(pull) remains constant, the person pulling the operating cord 529 downwardly will encounter little or no force gradient.

As the blind is raised still further by pulling downwardly on the back end 533 of the operating cord 529, still more of its slats come to rest on the upwardly moving bottom rail. As T(blind) again increases, it again reaches a new point where the difference between T(blind) and T(pull) is such that the new IT(spring+clutch) can no longer keep the slipping clutch halves 596, 597 coupled together. Since T(blind) has then increased, it is again slightly greater than T(pull), causing the clutch 591 to slip and the central shaft 543 again to rotate clockwise somewhat slower than the modified diabolo 561, thereby causing the right cone-like part 563 to rotate relative to the threaded part of the central shaft and to move to the left, thus further compressing the compression spring 591. As a result, d(pull) increases again as the right part 563 of the modified diabolo slides further into its left part 565, and the diameter of the gutter 577, around which the operating cord 529 is wound, increases—until a new dynamic balance is reached when: T(pull) is again at least slightly greater than T(blind); and IT(coil) no longer increases because T(blind) no longer exceeds T(pull) but IT(coil) is sufficiently strong so that the spring 591 is not compressed still further but it couples the central shaft 543 and the modified diabolo 561 to rotate clockwise together.

This cycle is repeated until the blind is completely raised.

The use of the compression spring 591 together with the slipping clutch 595 can be advantageous, as compared to the use of the coil spring 23, 123, 223, in some embodiments of the cord spool of this invention. This is because the forces of a compression spring are easier to regulate. Also, a compression spring generally takes up less space than a coil spring. The combination of a compression spring and a slipping clutch can also provide a more stable construction than can a single coil spring, although such a combination requires the use of an extra part.

Simply allowing a blind (not shown) to drop, as would be the case when using the cord spools 1, 101, 201, 301, 401, 501 of FIGS. 1–5 and 7–10, is generally not desirable. In order to regulate the speed of lowering the blind, a braking mechanism (not shown) can be provided in the head rail (not shown) of the blind. Any conventional braking mechanism can be used, such as the centrifugal brake of U.S. Pat. No. 4,838,333 or the plate brake of British patent application GB 2,313,431.

The cord spools 1, 101, 201, 301, 401, 501 of this invention can be used in otherwise conventional cord-operated blinds, such as Venetian blinds with horizontal slats, pleated blinds, honeycomb blinds and Roman blinds, where the blinds' opening mechanism involves winding lift cords around a central shaft or around spools mounted on the central shaft. The cord spool can also be used in otherwise conventional cord-operated blinds, such as roller blinds, where the blinds' opening mechanism involves winding the blinds around a central shaft. The cord spool can further be used in otherwise conventional cord-operated blinds with vertical slats, where the blinds' opening mechanism involves rotating a central shaft to move longitudinally carriers for slats. Of course, a motor could be connected to the front and rear ends 33, 35, 133, 135, 233, 235, 333, 335, 433, 435, 533, 535 of the operating cords 29, 129, 229, 329, 429, 529 of such window coverings to help move the operating cords when raising and lowering the coverings. Since the force needed to raise the coverings would be significantly reduced by the cord spools 1, 101, 201, 301, 401, 501, a less powerful motor might be used.

This invention is, of course, not limited to the above-described embodiments which may be modified without departing from the scope of the invention or sacrificing all of its advantages. In this regard, the terms in the foregoing description and the following claims, such as "longitudinal", "lateral", "axial", "radial", "clockwise", "counter-clockwise", "right" and "left", have been used only as relative terms to describe the relationships of the various elements of the cord spool of the invention for architectural coverings.

For example, in the cord spools 1, 101 and 201 of FIGS. 1, 5 and 7, the outer cone 13, 113, 213 and the pushing means 37, 137, 237 act as means for preventing or regulating (i.e., at least substantially reducing) an F(pull) gradient when driving the operating cord 29, 129, 229 to raise or open a blind. Likewise, the two-part diabolo 361, inverted diabolo 461 and modified diabolo 561 of FIGS. 8–10 act as means for preventing or regulating an F(pull) gradient when driving the operating cord 329, 429, 529 to raise or open a blind. In this regard, T(pull) is increased by increasing d(pull), while F(pull) remains constant. Such increases in d(pull) are provided by winding the operating cord 29, 129, 229, 329, 429, 529 over bigger diameters of the outer cone13, 113, 213 or the gutter 377, 477, 577 and are provided automatically by the action of the coil spring 23, 123, 223, 323, 423 and the compression spring 591 with the slipping clutch 595. However, other means, such as such as a variable gear box which can shift to bigger gears when a bigger F(pull) is needed, could be provided in a cord spool, between the central shaft and the operating cord of a window covering, for preventing or regulating an F(pull) gradient when driving the operating cord to open the covering.

Likewise, other variable coupling means, such as other spring-type clutches, could be used in the cord spool 1, 101, 201, 301, 401, 501 instead of the coil spring 23, 123, 223, 323, 423 and the compression spring 591 with the slipping clutch 595 for automatically actuating the means for preventing or regulating an F(pull) gradient so as to increase automatically d(pull) when the torque of the window covering on the central shaft 43, 143, 243, 343, 443, 543 is greater than the torque of the operating cord, as it is being pulled to open the covering.

Furthermore, in order to keep the upper coils 31, 231 of the operating cord 29, 229, to the left on the outer cone 13, 213 of the cord spools 1, 201 of FIGS. 1–4 and 7 from sliding over lower coils 31, 231 to the right on the outer cone when all the coils move to the right on the outer cone during the lowering of the blind, a bar (not shown) can be provided adjacent to the outer cone. Such a bar would preferably be spaced away from the outer cone by a little more than the thickness of the operating cord and be parallel to the outer surface 20, 220 of the outer cone, so that only a single cord thickness can slide between the outer cone and the bar, thus preventing the coils 31, 231 from moving over each other. Such a bar would, of course, also have to be spaced laterally away from the pusher tab(s) 41, 241.

Moreover, the central shaft 43, 143, 243, 343, 443, 543 of the blinds of FIGS. 1–5 and 7–10 and any mono-command mechanism connected to the central shaft could be located to the right, as well as the left, of the cord spool 1, 101, 201, 301, 401, 501 as shown in the Figures.

Furthermore, the pusher means 237 and extra pusher means 237A of FIG. 7C can be separate parts, each threaded on the inner cone 203. Alternatively, there can be a single pusher means 237 with connected extending separate pusher tabs 241 on opposite longitudinal sides of the coil(s) 231 of the operating cord 229.

Likewise, the coil spring 323 or 423 of the two-part diabolo 361 of FIG. 8 or inverted diabolo 461 of FIG. 9 could be connected to the left part 363 or 463, instead of the right part 365 or 465, without changing the operation of this cord spool 301 or 401, provided: i) the inner tab 325 or 425 of the coil spring is connected to, and longitudinally slidable along, the central shaft 343 or the right portion 483 of the clutch shaft 485, respectively; or ii) the right part 365 or 465 of the diabolo 361 or 461 is longitudinally slidable and the left part 363 or 365 is not.

Moreover, the right end 592 of the compression spring 591 could be attached to, rather than simply biased against, the left end 567 of the right cone-like part 563, but the left end 593 of the spring should not be attached to the right half 596 of the slipping clutch 595.

The left cone-like part 565 of the modified diabolo 561 could also be shaped to have a progressively decreasing diameter from its left end 573 to its right end 571.

We claim:

1. The combination of a covering for an architectural opening, a cord spool, cord and central shaft for operating and moving the covering between open and closed positions, the cord spool comprising: a circumferential surface, about which the cord is wound; means for regulating or preventing an F (pull) gradient when the central shaft is being rotated to open the covering; and a variable coupling means connected to the central shaft and the circumferential surface for automatically actuating the means for regulating or preventing an F (pull) gradient when a first torque on one of the central shaft or the cord, exerted by the window covering, is greater than a second torque on the circumferential surface, exerted by the other of the central shaft or the cord as the covering is being opened.

2. The combination of claim 1 wherein the cord is an operating cord that is wound about the circumferential surface, wherein the means for regulating or preventing an F(pull) gradient are mans for regulating or preventing an F(pull) gradient when pulling on one end of the operating cord to open the covering, and wherein the variable coupling means automatically actuates the means for regulating or preventing an F(pull) gradient when the first torque on the central shaft, exerted by the window covering, is greater than the second torque, exerted by the operating cord as the covering is being opened.

3. The combination of claim 2 wherein the means for regulating an F(pull) gradient comprises means for increasing the diameter of the circumferential surface.

4. The combination of claim 2 wherein the variable coupling means includes means for tightening when the first torque of the covering on the central shaft is greater than the second torque on the circumferential surface of the operating cord as it is being pulled to open the covering.

5. The combination of claim 2 wherein the variable coupling means comprises a spring having an inherent tightness that is intermittently less than the first torque of the covering on the central shaft minus the second torque of the operating cord on the circumferential surface during the opening of the covering.

6. The combination of claim 5 wherein the spring is a coil spring.

7. The combination of claim 2 wherein the means for regulating an F(pull) gradient comprises:

an outer cone having an outer surface that has: i) a first longitudinal end with a relatively small, first lateral diameter, ii) a second longitudinal end with a relatively much larger, second lateral diameter, and iii) an intermediate longitudinal section, between the ends of the outer cone and having progressively larger lateral diameters which increase longitudinally from the first end to the second end of the outer cone; the outer cone being rotatable about its longitudinal axis; the outer cone also having at least one longitudinally-extending slit between its first and second ends;

the operating cord being wound circumferentially about the outer surface of the outer cone in the first lateral direction and having a pair of depending end portions on laterally opposite sides of the outer cone;

an inner rod that is within the outer cone and has a first longitudinal end and a second longitudinal end, connected to the central shaft; an outer surface of the inner rod having a thread that is wound circumferentially in a first lateral direction and that advances from the first end to the second end of the inner rod; the inner rod being rotatable about its longitudinal axis; and means for pushing the operating cord longitudinally along the outer surface of the outer cone; the pushing means being slidable in the thread of the inner rod and extending through the slit and radially outwardly of the outer cone between: i) the pair of end portions of the operating cord and ii) the first end of the outer cone; the slit being adapted to urge the pushing means to move circumferentially in the thread of the inner rod when the outer cone rotates about the inner rod; and the variable coupling having a first end, connected to the second end of the inner rod, and a second end, connected to the second end of the outer cone; the variable coupling means being adapted to connect the outer cone and the inner rod so that they i) rotate together in the same direction and ii) the outer cone rotates relative to the inner cone when the first torque of the window covering on the central shaft is greater than the second torque of the operating cord on the circumferential surface, as it is being pulled to open the covering;

whereby when the first torque of the window covering on the central shaft is greater than the second torque of the operating cord on the circumferential surface, as it is being pulled to open the covering, the pushing means automatically moves the operating cord longitudinally along the outer surface of the outer cone.

8. The combination of claim 7 wherein the means for pushing the operating cord longitudinally comprises a following part, slidably movable along the thread of the inner rod and extending outwardly of the outer cone.

9. The combination of claim 8 wherein the following part comprises: a foot which fits loosely within the thread and a radially-extending pusher tab which is on the foot and extends through and outwardly of the slit in the outer cone; the foot being adapted to easily move circumferentially within the thread about the inner rod when the tab is pushed by rotation of the slit with rotation of the outer cone about the inner rod.

10. The combination of claim 7 wherein the second end of the inner rod is connected directly to the central shaft of the covering.

11. The combination of claim 7 further including a clutch for connecting the second end of the inner rod to the central shaft of the covering.

12. The combination of claim 7 wherein the inner rod is an inner cone, nested within the outer cone.

13. The combination of claim 7 further comprising a plurality of circumferentially spaced longitudinally-extending slits in the outer cone and a plurality of circumferentially spaced pushing means extending through the slits and radially outwardly of the outer cone.

14. The combination of claim 7 wherein the pushing means comprises a nut which can be threaded on the thread of the inner rod and a plurality of radially extending pusher tabs, spaced circumferentially on the nut and extending through the slits in the outer cone.

15. The combination of claim 2 wherein the means for regulating an F(pull) gradient comprises a two-part diabolo with:

a pair of intersecting parts of generally cone shape on opposite longitudinal sides;

a first part having a first longitudinal end of a first, relatively small, lateral diameter, a second longitudinal end of a second, relatively large, lateral diameter, and a longitudinally-extending intermediate section between its two ends;

a second part having a first longitudinal end of a first, relatively small, lateral diameter, a second longitudinal end of a second, relatively large, lateral diameter, and a longitudinally-extending intermediate section between its two ends;

the first end of the first part being slidably inserted longitudinally into the first end of the second part to form a gutter where the two parts cross and the operating cord being wound about the gutter;

one of the first and second parts being longitudinally movable relative to the other part which is longitudinally fixed; and the variable coupling means being connected to said one of the first and second parts and to the central shaft.

16. The combination of claim 15 wherein the central shaft comprises a threaded portion that is threadedly engaged by said one of the first and second parts.

17. The combination of claim 2 wherein the means for regulating an F(pull) gradient comprises an inverted diabolo with:

a pair of connected sides of generally cone shape on opposite longitudinal sides;

a first side having a first longitudinal end of a first, relatively small, lateral diameter, a second longitudinal end expandable to a second, relatively large, lateral diameter, and a longitudinally-extending intermediate section connecting its two ends;

a second side having a first longitudinal end of a first, relatively small, lateral diameter, a second longitudinal end expandable to a second, relatively large, lateral diameter, and a longitudinally-extending intermediate section connecting its two ends;

the second longitudinal end of the first side being hingedly connected to the second longitudinal end of the second side to form a gutter where the two ends are hingedly connected and the operating cord being wound about the gutter;

one of the first and second sides being longitudinally movable relative to the other side which is longitudinally fixed; and the variable coupling means being connected to said one of the first and second sides and to the central shaft.

18. The combination of claim 17 wherein the central shaft comprises a threaded portion that is threadedly engaged by said one of the first and second sides.

19. The combination of claim 2 wherein the variable coupling means comprises a compression spring and a slipping clutch.

20. The combination of claim 19 wherein the slipping clutch is between opposite ends of the central shaft and wherein the compression spring is rotatably positioned about the central shaft with opposite ends of the compression spring being biased against a side of the slipping clutch and against the means for regulating an F(pull) gradient.

21. The combination of claim 19 wherein the means for regulating an F(pull) gradient comprises a two-part diabolo with first and second, parts of generally cone shape on opposite longitudinal sides.

22. The combination of claim 21 wherein the central shaft comprises a threaded portion that is threadedly engaged by a movable one of said first and second parts.

23. The combination of claim 22 wherein the movable one of said first and second parts is movable along the central shaft towards the other part; wherein an end of the compression spring is biased against the movable one of said first and second parts and another end of the compression spring is biased against a first half of the slipping clutch that is rotatable about the central shaft; and wherein a second half of the slipping clutch is fixed on the central shaft; whereby the variable coupling means has an inherent tightness which is a function of a longitudinal force of the compression spring on the first half of the clutch and of the inherent sliding friction of facing surfaces of the slipping clutch halves, and the tightness of the variable coupling means increases due to compression of the spring when a first torque of the window covering, exerted on the central shaft, is greater than the second torque of the operating cord, exerted on the circumferential surface, as the cord is being pulled to open the covering, so that the tightness of the variable coupling means is intermittently less than the first torque of the covering on the central shaft minus the second torque of the operating cord on the circumferential surface during the raising of the blind.

24. The combination of claim 23 wherein the fixed second half of the slipping clutch is an integral part of the central shaft, and the two halves of the slipping clutch are fractionally engaged but can rotatably slip relative to one another.

25. The combination of claim 24 wherein the compression spring is rotatably positioned around the threaded portion of the central shaft.

26. The combination of claim 22 wherein the movable one of said first and second parts is separated from the first half of the slipping clutch by the fixed other part.

27. The combination of claim 22 wherein the compression spring and slipping clutch are adapted to couple the movable one of said first and second parts to the central shaft so that:

i) the movable one of said first and second parts and the central shaft rotate together in the same direction when a first torque on the central shaft, exerted by the window covering, is no more than a second torque on a gutter where said first and second parts cross, exerted by the operating cord as it is being pulled to open the covering; and ii) the movable one of said first and second parts rotates relative to the central shaft and moves longitudinally along the central shaft towards the slipping clutch when the first torque on the central shaft, exerted by the window covering, is greater than the second torque on the gutter, exerted by the operating cord as it is being pulled to open the covering; and iii) the diameter of the gutter increases as the movable one of said first and second parts moves longitudinally along the central shaft towards the slipping clutch.

28. The combination of claim 19 wherein the means for regulating an F(pull) gradient comprises an inverted diabolo with first and second sides on opposite longitudinal sides.

29. The combination of claim 28 wherein the central shaft comprises a threaded portion that is threadedly engaged by a movable one of said first and second sides.

30. The combination of claim 29 wherein the movable one of said first and second sides is movable along the central shaft towards the other side; wherein an end of the compression spring is biased against the movable one of said first and second sides and another end of the compression spring is biased against a first half of the slipping clutch that is rotatable about the central shaft; and wherein a second half of the slipping clutch is fixed on the central shaft; whereby the variable coupling means has an inherent tightness which is a function of a longitudinal force of the compression spring on the first half of the clutch and of the inherent sliding friction of facing surfaces of the slipping clutch halves, and the tightness of the variable coupling means increases due to compression of the spring when a first torque of the window covering, exerted on the central shaft, is greater than a second torque of the operating cord, exerted on the circumferential surface, as the cord is being pulled to open the covering, so that the tightness of the variable coupling means is intermittently less than the first torque of the covering on the central shaft minus the second torque of the operating cord on the circumferential surface during the raising of the blind.

31. The combination of claim 30 wherein the fixed second half of the slipping clutch is an integral part of the central shaft, and the two halves of the slipping clutch are fractionally engaged but can rotatably slip relative to one another.

32. The combination of claim 31 wherein the compression spring is rotatably positioned around the threaded portion of the central shaft.

33. The combination of claim 29 wherein the movable one of said first and second sides is separated from the first half of the slipping clutch by the fixed other side.

34. The combination of claim 29 wherein the compression spring and slipping clutch are adapted to couple the movable one of said first and second sides to the central shaft so that:

i) the movable one of said first and second sides and the central shaft rotate together in the same direction when a first torque on the central shaft, exerted by the window covering, is no more than a second torque on a gutter where said first and second sides come together, exerted by the operating cord as it is being pulled to open the covering; and ii) the movable one of said first and second sides rotates relative to the central shaft and moves longitudinally along the central shaft towards the slipping clutch when the first torque on the central shaft, exerted by the window covering, is greater than the second torque on the gutter, exerted by the operating cord as it is being pulled to open the covering; and iii) the diameter of the gutter increases as the movable one of said first and second sides moves longitudinally along the central shaft towards the slipping clutch.

35. An architectural covering comprising a cord, a rotatable central shaft; and a cord spool operatively connected to said central shaft, said cord spool comprising a circumferential surface, about which said cord can be wound that can be driven in opposite directions to open and close the covering;

means for regulating an F(pull) gradient when pulling on one end of the cord to open the covering; and a variable coupling means connected to the central shaft and the circumferential surface for automatically actuating the means for regulating an F(pull) gradient when a first torque on the central shaft, exerted by the covering, is greater than a second torque on the circumferential surface, exerted by the cord as it is being pulled to open the covering.

* * * * *